US007422306B2

(12) United States Patent
Tatsumi et al.

(10) Patent No.: US 7,422,306 B2
(45) Date of Patent: Sep. 9, 2008

(54) IMAGE PROCESSING METHOD, IMAGE PROCESSING APPARATUS, AND IMAGE RECORDING APPARATUS

(75) Inventors: Setsuji Tatsumi, Kanagawa (JP); Yuhei Chiwata, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 239 days.

(21) Appl. No.: 11/484,571

(22) Filed: Jul. 12, 2006

(65) Prior Publication Data

US 2007/0013731 A1 Jan. 18, 2007

(30) Foreign Application Priority Data

Jul. 13, 2005 (JP) ..... 2005-204467

(51) Int. Cl.
*B41J 29/393* (2006.01)

(52) U.S. Cl. ..... 347/19

(58) Field of Classification Search ..... 347/15, 347/19, 43, 12; 358/1.2, 1.9
See application file for complete search history.

(56) References Cited

U.S. PATENT DOCUMENTS 6,464,321 B1 * 10/2002 Nunokawa ..... 347/19
6,764,156 B2 * 7/2004 Mantell ..... 347/14
2004/0017415 A1 * 1/2004 Nunokawa ..... 347/15

FOREIGN PATENT DOCUMENTS

EP 1 555 125 A1 7/2005
JP 2-86457 A 3/1990
JP 2004-188956 A 7/2004

* cited by examiner

*Primary Examiner*—Lamson Nguyen
(74) *Attorney, Agent, or Firm*—Birch, Stewart, Kolasch & Birch, LLP

(57) ABSTRACT

The image processing method comprises the steps of: obtaining a distance between an ejection surface of a liquid ejection head in which a plurality of liquid droplet ejection ports are formed, and a recording surface onto which liquid droplets ejected from the liquid droplet ejection ports are deposited; identifying an amount of depositing position displacement of the liquid droplet ejected from each of the liquid droplet ejection ports on the recording surface, according to the distance; and generating droplet ejection arrangement data by correcting image data according to the identified amount of depositing position displacement and performing a halftoning process of the corrected image data.

10 Claims, 17 Drawing Sheets

FIG.18

AMOUNT OF DEPOSITING POSITION DISPLACEMENT

| | AMOUNT OF DEPOSITING POSITION DISPLACEMENT | |
|---|---|---|
| DISTANCE BETWEEN NOZZLE AND MEDIUM | OBLIQUE FLIGHT ANGLE:1DEG. | OBLIQUE FLIGHT ANGLE:2DEG. |
| 0.5 mm | 2.8 μm | 5.6 μm |
| 0.75 | 4.2 | 8.3 |
| 1 | 5.6 | 11.1 |
| 1.25 | 6.9 | 13.9 |
| 1.5 | 8.3 | 16.7 |
| 1.75 | 9.7 | 19.4 |
| 2 | 11.1 | 22.2 |

IMAGE PROCESSING METHOD, IMAGE PROCESSING APPARATUS, AND IMAGE RECORDING APPARATUS

BACKGROUND OF THE INVENTION

1. Field of the Invention

The present invention relates to an image processing method, an image processing apparatus, and an image recording apparatus, and more particularly, to image processing technology suitable for suppressing the occurrence of banding caused by variation in the depositing positions of liquid droplets in an inkjet recording apparatus including a recording head having a plurality of liquid droplet ejection ports (nozzles), and an image recording apparatus using the image processing technology.

2. Description of the Related Art

In an inkjet recording apparatus, banding (stripe-shaped density non-uniformity) can occur in the recorded image due to the depositing positions of the ink ejected from the nozzles being displaced from the prescribed positions, and such banding may lead to degradation of the image quality. In particular, when recording is carried out with a line head system (Full Width Array) which records an image by means of one scan, banding caused by displacement of the depositing positions which is intrinsic to the nozzles can be remarkable, and this banding may lead to a significant problem.

The principal cause of depositing position displacement is the flight in an oblique direction of a liquid droplet, due to degradation or scratching of the lyophobic film in the vicinity of the nozzles, or the adhesion of ink mist or dirt to the vicinity of the nozzles. Therefore, if the distance between the nozzles and the liquid surface (recording surface) changes, then the depositing positions of the ejected droplets change and the degree of banding changes accordingly. The table in FIG. 18 shows an example of the relationship between the distance from a nozzle to a medium, and the amount of depositing position displacement, and it shows a case where the oblique flight angle is 1 degree (namely, the direction of flight is displaced through 1 degree with respect to the direction of the normal flight), and a case where the oblique flight angle is 2 degrees. As shown in FIG. 18, the amount of displacement in the depositing position changes in accordance with the distance between the nozzle and the medium, and the oblique angle of flight. The distance between the nozzle and the medium changes with the thickness of the medium, and the like.

Japanese Patent Application Publication No. 2-86457 addresses the problem of the occurrence of variation in image quality based on the degree of variation of the depositing positions in accordance with the thickness of the recording material (in other words, based on the distance between a nozzle and a medium). Japanese Patent Application Publication No. 2-86457 provides a device for controlling the distance between the nozzle surface and the medium in accordance with the thickness of the medium, as the solution for the above problem.

Japanese Patent Application Publication No. 2004-188956 discloses a composition in which a flight deflection device which controls the direction of flight of the ejected droplets is provided as a device for reducing the visibility of banding. According to this composition, the amount of deflection is varied in accordance with the distance between the nozzle surface and the medium.

However, the composition disclosed in Japanese Patent Application Publication No. 2-86457 requires a control mechanism involving a mechanical distance, and accordingly it is expensive. Furthermore, the composition disclosed in Japanese Patent Application Publication No. 2004-188956 requires two drive elements (thermal elements) with respect to each nozzle, and accordingly it is also costly.

Furthermore, in order to correct the banding as described above, it is necessary to measure the state of depositing position displacement; however, as shown in the table in FIG. 18, the amount of this displacement generally changes within a range of several μm to 20 μm. Consequently, it is required to measure the amount of displacement of the μm order, with a high degree of accuracy.

SUMMARY OF THE INVENTION

The present invention is contrived in view of the aforementioned circumstances, an object thereof being to provide an image processing method, an image processing apparatus, and an image recording apparatus using same, whereby depositing position displacement caused by an oblique flight of a liquid droplet which varies in accordance with the distance between the nozzle surface and the recording surface can be corrected with good accuracy.

In order to attain the aforementioned object, the present invention is directed to an image processing method comprising the steps of: obtaining a distance between an ejection surface of a liquid ejection head in which a plurality of liquid droplet ejection ports are formed, and a recording surface onto which liquid droplets ejected from the liquid droplet ejection ports are deposited; identifying an amount of depositing position displacement of the liquid droplet ejected from each of the liquid droplet ejection ports on the recording surface, according to the distance; and generating droplet ejection arrangement data by correcting image data according to the identified amount of depositing position displacement and performing a halftoning process of the corrected image data.

According to this aspect of the present invention, the depositing position displacement which changes in accordance with the distance between the ejection surface of the liquid ejection head and the recording surface (for example, depositing position displacement due to the oblique flight of an ejected droplet) is identified on the basis of a correlation with the distance; the image data is corrected on the basis of the identified amount of depositing position displacement, with a view to suppressing the occurrence of banding caused by the depositing position displacement; and then a halftoning process is carried out to obtain the droplet ejection arrangement (dot arrangement) data. Consequently, it is possible to achieve highly accurate correction to suitably compensate the depositing position displacement which changes with the distance between the ejection surface and the recording surface, and hence a droplet ejection arrangement which reduces the visibility of banding caused by depositing position displacement can be achieved.

Furthermore, according to this aspect of the present invention, correction on the basis of the depositing position displacement is carried out at the stage of the image signal processing when the droplet ejection arrangement is determined. Consequently, in contrast to the technology described in Japanese Patent Application Publication No. 2-86457 and Japanese Patent Application Publication No. 2004-188956, it is not necessary to add a mechanical control mechanism or drive elements for deflecting the flight of the droplets, and hence the corrective effect can be achieved at relatively low cost.

In order to attain the aforementioned object, the present invention is also directed to an image processing method comprising the steps of: acquiring information on an amount of depositing position displacement of a liquid droplet ejected from each of liquid droplet ejection ports, the amount of depositing position displacement being measured on a first recording surface situated at a first distance from an ejection surface of a liquid ejection head in which the liquid droplet ejection ports are formed; acquiring information on a second distance with respect to a second recording surface situated at the second distance from the ejection surface, the second distance being different from the first distance; determining an amount of depositing position displacement on the second recording surface according to the first distance, the second distance, and the amount of depositing position displacement measured on the first recording surface; and generating droplet ejection arrangement data by correcting image data according to the amount of depositing position displacement measured on the second recording surface and performing a halftoning process of the corrected image data.

According to this aspect of the present invention, it is possible to estimate (calculate by calculation) the amount of depositing position displacement on the second recording surface situated at the second distance from the ejection surface, on the basis of the information on the amount of depositing position displacement on the first recording surface, which is separated by the first distance from the ejection surface. In this second depositing position error calculation step, it is possible to use a function indicating the correlation between the distance from the ejection surface to the recording surface, and the amount of depositing position displacement, and it is also possible to use a look-up table, or the like. Therefore, actual measurement of the amount of depositing position displacement on the second recording surface is not required. More specifically, according to this aspect of the present invention, it is not necessary to measure the amount of depositing position displacement for each recording surface of a plurality of types of recording surfaces having different distances from the ejection surface; after measuring the amount of depositing position displacement on the first recording surface situated at the first distance, which forms a reference, it is possible to determine the depositing position displacement at the recording surface in question simply by identifying the distance between the recording surface in question and the ejection surface. Therefore, highly accurate correction can be achieved readily with respect to a wide variety of recording surfaces. Furthermore, it is also possible to omit a test print for measurement and suppress wasteful consumption of recording medium. In estimating the amount of depositing position displacement on the second recording surface (in the second depositing position error calculation step), it is possible to use a function (or a calculation formula) which indicates the correlation between the distance from the ejection surface to the recording surface, and the amount of depositing position displacement, and it is also possible to use a look-up table, and the like.

Preferably, the first distance is longer than the second distance.

The longer the distance between the ejection surface and the recording surface (namely, the longer the flight distance) becomes, the larger the amount of depositing position displacement caused by oblique flight of ejected droplets (namely, the error from an ideal depositing position on the recording surface) becomes. Hence, by measuring the amount of depositing position displacement on the first recording surface situated at the first distance forming a longer flight distance, the amount of displacement can be measured readily and the accuracy required of the displacement measurement device can be reduced.

In order to attain the aforementioned object, the present invention is also directed to an image processing apparatus comprising: a distance identification device which identifies a distance between an ejection surface of a liquid ejection head in which a plurality of liquid droplet ejection ports are formed, and a recording surface onto which liquid droplets ejected from the liquid droplet ejection ports are deposited; a depositing position error calculation device which determines an amount of depositing position displacement of the liquid droplet ejected from each of the liquid droplet ejection ports on the recording surface, according to the distance; and a droplet ejection arrangement determination device which generates droplet ejection arrangement data by correcting image data according to the amount of depositing position displacement determined by the depositing position error calculation device and performing a halftoning process of the corrected image data.

For the device which identifies the distance between the ejection surface and the recording surface (the distance identification device), it is possible to use a measurement device which actually measures the distance, and it is also possible to use a device which acquires information on the thickness of the recording medium used. As a device which acquires information on the thickness of the recording medium, apart from a device which actually measures the thickness, it is also possible to adopt a mode in which thickness information is input by means of a user interface, a mode where the thickness information is read in from an information recording unit attached to the container (magazine, cassette, or the like) which accommodates the recording medium, or the like.

In order to attain the aforementioned object, the present invention is also directed to an image processing apparatus comprising: a first depositing position error information acquisition device which acquires information on an amount of depositing position displacement of a liquid droplet ejected from each of liquid droplet ejection ports, the amount of depositing position displacement being measured on a first recording surface situated at a first distance from an ejection surface of a liquid ejection head in which the liquid droplet ejection ports are formed; a second distance information acquisition device which acquires information on a second distance with respect to a second recording surface situated at the second distance from the ejection surface, the second distance being different from the first distance; a second depositing position error calculation device which determines an amount of depositing position displacement on the second recording surface according to the first distance, the second distance, and the amount of depositing position displacement measured on the first recording surface; and a droplet ejection arrangement determination device which generates droplet ejection arrangement data by correcting image data according to the amount of depositing position displacement on the second recording surface determined by means of the second depositing position error calculation device and performing a halftoning process of the corrected image data.

The device (first depositing position error information acquisition device) which acquires information on the amount of depositing position displacement on the first recording surface situated at the first distance may store information relating to the previously measured amount of depositing position displacement in a storage device, such as a memory, in such a manner that information can be acquired subsequently by reading out the required information, or it may acquire information on the amount of depositing position displacement by actually printing a test pattern, or the like, reading in the print results, and performing suitable analytical processing. Considering that the amount of depositing position displacement changes with the circumstances, a desirable mode is one in which the information is updated at a suitable time.

For the device (the second distance information acquisition device) which acquires the information on the second distance, it is possible to use a measurement device which actually measures the distance, and it is also possible to use a device which acquires information on the thickness of the recording medium used. As a device which acquires information on the thickness of the recording medium, apart from a device which actually measures the thickness, it is also possible to adopt a mode in which thickness information is input by means of a user interface, a mode where the thickness information is read in from an information recording unit attached to the container (magazine, cassette, or the like) which accommodates the recording medium, or the like.

Preferably, the droplet ejection arrangement determination device comprises: a correction range setting device which sets N liquid droplet ejection ports used for correcting output density (where N is an integer not less than 2), of the liquid droplet ejection ports; a correction coefficient determination device which determines density correction coefficients for liquid droplets ejected from the N liquid droplet ejection ports, according to a correction condition including a condition whereby a differential coefficient at a frequency origin (f=0) of a power spectrum representing spatial frequency characteristics of density non-uniformities occurring due to a depositing position error of each of the liquid droplets ejected from the liquid droplet ejection ports, becomes substantially zero; and a correction processing device which performs calculation for correcting the output density by using the density correction coefficients determined by the correction coefficient determination device.

Irregularities in the density of a recorded image (density non-uniformities) can be represented by the intensity of the spatial frequency characteristics (power spectrum), it is difficult for human beings to visually identify the high frequency part, and the visibility of density non-uniformity can be evaluated by means of the low-frequency component of the power spectrum. According to this aspect of the invention, the density correction coefficients are determined by using a condition under which the differential coefficient at the frequency origin point (f=0) of the power spectrum after correction based on the density correction coefficients becomes substantially zero, and hence the intensity of the power spectrum can become a minimum at the frequency origin point and the power spectrum can be restricted to a low value in the vicinity of the origin (in other words, in the low-frequency region). Accordingly, highly accurate correction of non-uniformity can be achieved.

According to one mode of this aspect of the invention, the correction condition can be expressed by N simultaneous equations obtained on the basis of conditions for preserving the direct current (DC) component of the spatial frequency, and conditions at which the different coefficients up to the N−1th order become substantially zero.

If the density correction coefficients are determined respectively for the N correction nozzles, then since there are N unknown numbers, N simultaneous equations are obtained by using conditions for preserving the DC component and conditions whereby the differential coefficients up to the N−1th order become substantially zero. By solving these equations, it is possible to obtain all of the unknown numbers.

Furthermore, by satisfying conditions whereby the higher order differential coefficients become substantially zero, the degree of increase in the power spectrum is further restricted with respect to increase in the frequency from the origin point of the frequency range, and the intensity of the low-frequency component is kept to a lower value.

Taking the index which identifies the position of a nozzle (liquid droplet ejection port) to be i, for example, and the recording position of the nozzle i to be xi, then the density correction coefficient di for a nozzle i is specified by using the following formula:

$$d_i = \begin{cases} \dfrac{\prod_k x_k}{x_i \cdot \prod_{k \neq i} (x_k - x_i)} - 1 & \text{(for the correction object nozzle)} \\ \dfrac{\prod_k x_k}{x_i \cdot \prod_{k \neq i} (x_k - x_i)} & \text{(for nozzles other than the correction object nozzle)} \end{cases} \quad \text{(Formula 1)}$$

Looking in particular at the center of gravity position of the density profile, it is possible to obtain an equation for calculating the density correction coefficient by means of arithmetical processing using a δ function type of print model by which the approximation of the profile is performed on the basis of a δ function. The application of this aspect of the present invention to an actual apparatus is not limited to a mode where the precise solution provided by the above calculation formula (Formula 1) is used directly, and it is also possible to revise the value to a practicable value, by applying suitable correction to the precise solution.

In respect of the depositing position error of a nozzle indicated by index k, of the plurality of nozzles, density correction coefficients are determined respectively for the nozzles in the range of N correction nozzles peripheral to the nozzle k and including the nozzle k, and taking d(i,k) to be the density correction coefficient of a nozzle i with respect to the depositing position error of the nozzle k, the total density correction coefficient di for the nozzle i is determined as linear combination of the d(i,k) values determined for different values of k.

At any particular nozzle i, density correction coefficients with respect to the depositing position errors of a plurality of nozzles are determined respectively and independently, and the total density correction coefficient of that nozzle i is determined by combination (linear combination) of the independently calculated density correction coefficients.

In this case, it is possible to take the depositing position error of all of the recording elements (all of the k values) as objects for correction and to determine the linear combination of all of the d(i,k) values accordingly, and it is also possible to determine the linear combination of the d(i,k) values relating to a portion of the index k values selected on the basis of certain conditions, for instance, by setting only those nozzles having a depositing position error exceeding a prescribed threshold value as objects for correction, or the like.

In order to attain the aforementioned object, the present invention is also directed to an image recording apparatus comprising: a liquid ejection head in which a plurality of liquid droplet ejection ports are formed; a conveyance device which causes the liquid ejection head and a recording medium to move relatively to each other by conveying at least one of the liquid ejection head and the recording medium; a storage device which stores information on a first distance and information on an amount of depositing position displacement of a liquid droplet ejected from each of the liquid droplet ejection ports, the amount of depositing position displacement being measured on a first recording surface situated at the first distance from an ejection surface of the liquid ejection head; a second distance information acquisition device which acquires information on a second distance with respect to a second recording surface situated at the second distance from the ejection surface, the second distance being different from the first distance; a second depositing position error calculation device which determines an amount of depositing position displacement on the second recording surface according to the first distance stored in the storage device, the amount of depositing position displacement on the first recording surface stored in the storage device, and the second distance acquired by the second distance information acquisition device; a droplet ejection arrangement determination device which generates droplet ejection arrangement data by correcting image data according to the amount of depositing position displacement on the second recording surface determined by means of the second depositing position error calculation device and performing a halftoning process of the corrected image data; and an ejection control device which controls an ejection operation of the liquid droplet ejection ports according to the droplet ejection arrangement data generated by the droplet ejection arrangement determination device.

The inkjet recording apparatus according to one mode of the image recording apparatus of this aspect of the present invention comprises: a liquid ejection head (corresponding to a "recording head") having a liquid droplet ejection element row in which a plurality of liquid droplet ejection elements are arranged in a row, each liquid droplet ejection element comprising a nozzle for ejecting an ink droplet in order to form a dot and a pressure generating device (piezoelectric element, heating element, or the like) which generates an ejection pressure; and an ejection control device which controls the ejection of a liquid droplet from the recording head on the basis of droplet ejection arrangement data generated from the image data. An image can be formed on a recording medium by means of the liquid droplets ejected from the nozzles.

One compositional embodiment of a recording head is a full line type head in which a plurality of nozzles are arranged through a length corresponding to the full width of the recording medium. In this case, a mode may be adopted in which a plurality of relatively short recording head modules having nozzle rows which do not reach a length corresponding to the full width of the recording medium are combined and joined together, thereby forming nozzle rows of a length corresponding to the full width of the recording medium.

A full line type head is usually disposed in a direction that is perpendicular to the relative feed direction (relative conveyance direction) of the recording medium, but a mode may also be adopted in which the recording head is disposed in an oblique direction that forms a prescribed angle with respect to the direction perpendicular to the conveyance direction.

A "recording medium" is a medium onto which the liquid ejected from the liquid ejection head (recording head) is deposited, and it receives the recording of an image by the action of the recording head. More specifically, the "recording medium" indicates a print medium, image forming medium, image receiving medium, ejection receiving medium, or the like. This "recording medium" includes various types of media, irrespective of material and size, such as continuous paper, cut paper, sealed paper, resin sheets such as OHP sheets, film, cloth, a printed circuit board on which a wiring pattern, or the like, is formed, and an intermediate transfer medium, and the like.

The "conveyance device" may include a mode where the recording medium is conveyed with respect to a stationary (fixed) recording head, a mode where a recording head is moved with respect to a stationary recording medium, and a mode where both the recording head and the recording medium are moved.

In the case of a color image is formed by means of an inkjet head, it is possible to provide a recording head for each color of a plurality of colored inks (recording liquids), or it is possible to eject inks of a plurality of colors, from one recording head.

Furthermore, the applications of this aspect of the present invention may is not limited to a full line head, and this aspect of the present invention may also be applied to a shuttle scanning type recording head (a recording head which ejects droplets while moving reciprocally in a direction substantially perpendicular to the conveyance direction of the recording medium).

Preferably, the image recording apparatus further comprises: a test pattern recording control device which controls ejection driving of the liquid ejection head in such a manner that a prescribed test pattern is recorded on the first recording surface; and a measurement device which measures the amount of depositing position displacement according to the test pattern recorded onto the first recording surface, wherein the information on the amount of depositing position displacement measured by the measurement device is stored in the storage device.

According to this aspect of the present invention, it is possible to estimate (or calculate by calculation) the amount of depositing position displacement on the first recording surface situated at the second distance from the ejection surface, on the basis of the information on the amount of depositing position displacement at the first distance stored in advance in the storage device, and therefore actual measurement of the amount of depositing position displacement on the second recording surface is not necessary.

Preferably, the first recording surface is a surface of a conveyance belt which serves to convey the recording medium.

According to this aspect of the present invention, a recording medium for test printing is not required, and hence there is a merit in that consumption of the recording medium can be restricted. Furthermore, in comparison with a case where a recording medium held on the conveyance belt forms a first recording surface, if the conveyance belt itself is taken as the first recording surface, then the flight distance of the ejection droplets becomes longer, the amount of depositing position displacement caused by the oblique flight increases, and the amount of displacement therefore becomes easier to measure.

According to the present invention, it is possible to correct depositing position displacement which changes in accordance with the distance between the ejection surface of the liquid ejection head and the recording surface, with extremely good accuracy.

BRIEF DESCRIPTION OF THE DRAWINGS

The nature of this invention, as well as other objects and benefits thereof, will be explained in the following with reference to the accompanying drawings, in which like reference characters designate the same or similar parts throughout the figures and wherein:

FIG. 18 is a chart showing an example of the relationship between the nozzle to medium distance, and the amount of depositing position displacement.

DETAILED DESCRIPTION OF THE PREFERRED EMBODIMENTS

Method of Ascertaining Amount of Depositing Position Displacement

Figure 1:
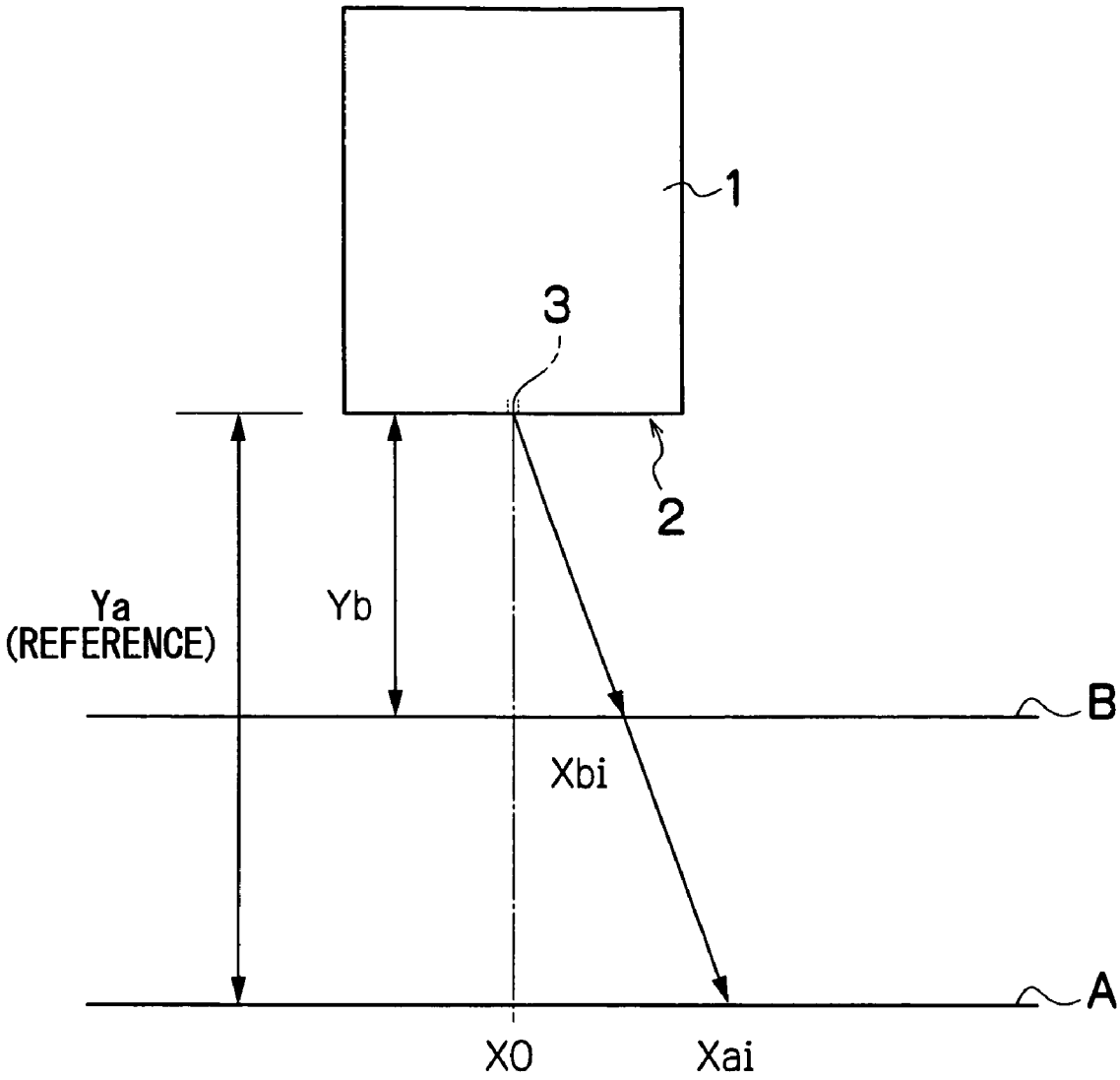
FIG. 1 is a schematic drawing showing the relationship between the amount of depositing position displacement caused by oblique flight of ejected droplets, and the nozzle surface to recording surface (medium surface) distance.

Firstly, the method of ascertaining the amount of depositing position displacement corresponding to each nozzle is described below, with reference to FIG. 1. In FIG. 1, reference numeral 1 denotes a recording head and reference numeral 2 denotes an ink ejection surface (nozzle surface). In the below explanation, the depositing position displacement is considered by looking specifically at one nozzle 3 (the ith nozzle); however, in fact, a plurality of nozzles are formed on the nozzle surface 2 of the recording head 1. Furthermore, the sign A in FIG. 1 indicates the recording surface of a medium forming a measurement reference (the recording surface indicated by the sign A corresponds to a first recording surface), and the sign B indicates the recording surface of the medium on which it is sought to record (the recording surface indicated by the sign B corresponds to a second recording surface).

The distance (corresponding to the first distance) between the medium A on which a test pattern is printed, and a nozzle surface 2 is taken to be Ya; and a prescribed test print is made on the medium A and the print results are measured. The ideal depositing position on the medium A pertaining to the ith nozzle 3 is taken to be X0, and the amount of displacement of the depositing position caused by an oblique flight of a liquid droplet from the nozzle 3 (the depositing position error from the ideal depositing position X0) is taken to be Xai. In this way, information relating to the distance Ya between the nozzle surface 2 and the medium A, and the depositing position displacement Xai, is obtained.

If the distance (corresponding to the second distance) between the medium B onto which recording is actually to be performed, and the nozzle surface 2, is taken to be Yb (where Yb<Ya), then the amount Xbi of depositing position displacement predicted for the medium B is determined by means of the following equation, $$Xbi=(Yb/Ya)\times Xai \tag{2}$$

Correction of the droplet ejection arrangement (described in detail hereinafter) is performed on the basis of this Xbi value.

A possible mode is one in which a test pattern for measuring depositing position displacement is printed and measured at a timing after a maintenance operation in the recording head, for example. In such a maintenance operation, ink mist, dirt and the like, on the nozzle surface 2 are removed by applying suction to the nozzles 3 or wiping the nozzle surface 2, and hence the depositing position displacement may significantly change between before and after the maintenance operation. Therefore, a desirable mode is one in which the depositing position displacement is measured after a maintenance operation is performed.

However, it is not necessary to perform the measurement after each and every maintenance operation. Since the oblique flight due to degradation or scratching of the lyophobic film in the vicinity of the nozzles is a fixed phenomenon (in other words, a phenomenon in which the change is little over time), then if this is the dominant cause, a mode may be adopted in which the measurement is performed each time when the apparatus is started up, or at daily or weekly intervals, or the like. If there is marked adherence of ink mist or dirt in the vicinity of the nozzles, due to the effects of the ink characteristics or the environment, then it is desirable to increase the frequency of measurement.

A print determination device (for example, a CCD scanner), equipped with an image sensor (a line sensor or area sensor) for capturing the print results of the test print is used for measuring the amount of depositing position displacement. The test pattern is read in by the print determination device and the image signal thus obtained is analyzed (processed), and thereby the amount Xai of depositing position displacement is determined.

Desirably, the medium A for printing the test pattern is a medium having hard-to-bleeding characteristics, (for example, a medium having a porous image receiving layer, or special inkjet photographic paper can be used as the medium A). If a medium of this kind is used, then clean dot shapes are reproduced on the medium, and the accuracy of the depositing position displacement measurement is improved.

Alternatively, a mode is also possible in which the actual conveyance belt used to hold and convey the recording medium is also used as the medium A. More specifically, a mode is also possible in which the test pattern is printed directly onto the conveyance belt. In this case, in addition to the merit of avoiding wasteful consumption of media, the following benefits can be also obtained. In a mode where a test pattern is printed on the conveyance belt, the flight distance of the liquid droplets becomes the longest distance, and hence the amount of depositing position displacement caused by the oblique flight also increases (the flight distance is shortened due to the thickness of the medium when a medium for test printing is mounted on the conveyance belt, and therefore, the distance Ya is a maximum when printing onto a conveyance belt on which no medium is mounted is performed). Consequently, the measurement of the amount of depositing position displacement by the print determination unit is facilitated. Furthermore, in the case of a composition in which a print determination device is attached to a prescribed position of the apparatus, since the observation distance of the sensor of the print determination device is a fixed value (namely, the distance between the sensor and the belt is a fixed value), then the optical sensor in the print determination device may have a shallow depth of focus.

It is also possible to use a measurement device which measures distance by means of a pulse laser, for example, for the measurement of the distance between the nozzle surface and the medium. Furthermore, information on the thickness of the medium may be supplied via a user interface. In this case, if, furthermore, the test pattern is printed onto the conveyance belt, then the distance Ya can be designed to be a fixed value. Hence the distance measurement is unnecessary (since the distance Yb can be calculated on the basis of the distance Ya and the thickness of the medium), and an apparatus composition where the measurement device (measurement apparatus) for measuring the distance between the nozzle surface and the medium is omitted can be adopted.

Processing Sequence

Figure 2:
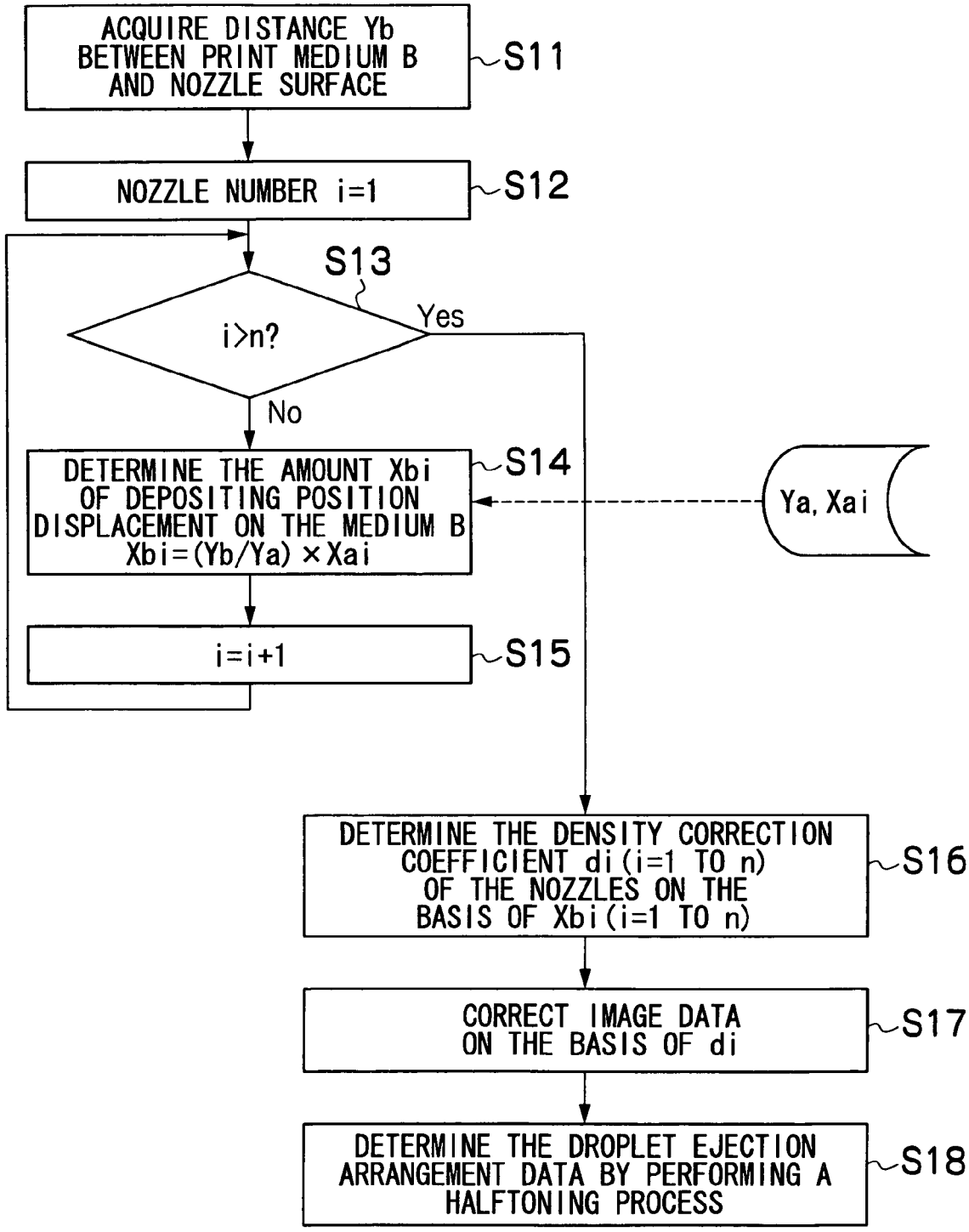
FIG. 2 is a flowchart showing a procedure of image processing including correction in accordance with the amount of depositing position displacement.

FIG. 2 is a flowchart showing a procedure of image processing. As a premise of this processing, the values of Ya and Xai have been measured previously, and this information has been stored in a storage device, such as a memory.

As shown in FIG. 2, firstly, information on the distance Yb between the medium (print medium) B on which printing is to be performed, and the nozzle surface, is acquired (step S11). As stated above, information on Yb is acquired by actually measuring the distance by means of a distance measuring device using a laser, or the like, or alternatively, the information on the distance Yb may be supplied by inputting thickness information on the medium B via a user interface.

Thereupon, the value of the parameter i which indicates the number of the nozzle under consideration is set to 1 (initialized) (step S12). Thereupon, the procedure advances to step S13, and it is determined whether the value of i has exceeded the total number of nozzles in the recording head, n, or not.

If the value of i has not exceeded n, then the procedure advances to step S114, and a calculation for determining the amount Xbi of depositing position displacement on the medium B is performed on the basis of the calculation equation shown in (equation (2)) above. In this case, the previously stored information on Ya and Xai is used. The information on Xbi determined at step S14 is stored (saved) in a storage device, such as a memory. Thereafter, the value of the nozzle number i under consideration is increased by 1 (the value of i is incremented by 1) at step S15, and the procedure then returns to step S13.

The processing in steps S13 to S15 is repeated, and the amount of depositing position displacement Xbi is thereby calculated in respect of all of the nozzles (i=1 to n). When the amount of depositing position displacement Xbi has been calculated in respect of all of the nozzles (i=1 to n), then "i>n" is satisfied at the determination in step S13, and hence the procedure advances to step S16.

At step S16, the density correction coefficient di (i=1 to n) for each nozzle is determined on the basis of the values of Xbi (i=1 to n) as derived above. Thereupon, the data of the input image to be printed is corrected on the basis of the density correction coefficients di (i=1 to n) (step S17), and halftoning processing is carried out on the basis of the corrected image data, thus determining droplet ejection arrangement data (step S18).

The ejection operation in each nozzle of the recording head is controlled on the basis of the droplet ejection arrangement data determined in this way.

One example of the correctional processing in steps S16 to S18 is described below.

Correction Principles of Droplet Ejection Arrangement

In the correction processing for density non-uniformities according to an embodiment of the present invention described here, when correcting the depositing position error (depositing position displacement) of a particular nozzle, correction is performed by using N pieces of nozzles including the particular nozzle and the nozzles surrounding the particular nozzle. As described in detail below, the greater the number of nozzles N used for correction, the greater the correction accuracy.

Figure 3:
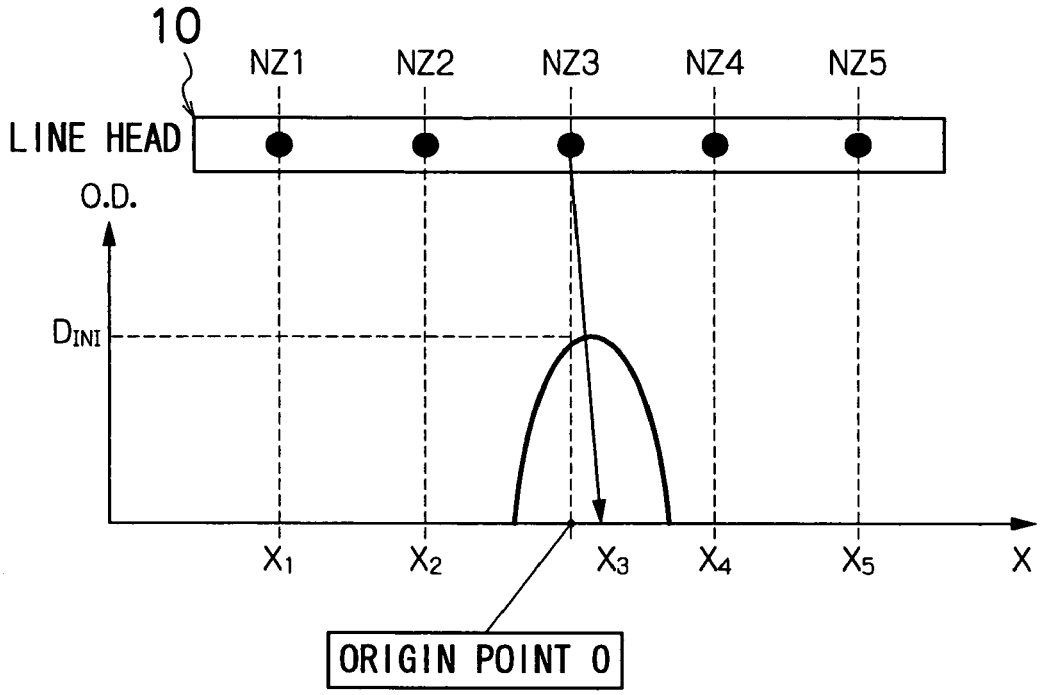
FIG. 3 is an illustrative diagram showing an embodiment of a density profile before correction of density non-uniformity according to an embodiment of the present invention.

FIG. 3 is a diagram of a mode before correction. In FIG. 3, the third nozzle (NZ3) from the left in a line head 10 (which is equivalent to a recording head) has a depositing position error, and hence the depositing position is displaced from the ideal depositing position (the origin O) in the rightward direction in the diagram (the main scanning direction indicated by the X axis). Furthermore, the graph shown in the bottom part of FIG. 3 indicates the density profile of the nozzle column direction (main scanning direction), obtained by averaging the print density produced by the droplets ejected from each nozzle in the conveyance direction of the recording medium (the sub-scanning direction). Here, since correction relating to the printing by the nozzle NZ3 is considered in FIG. 3, the density outputs of the nozzles other than the nozzle NZ3 are not shown in FIG. 33.

The initial output density of each of the nozzles NZ1 to NZ5 is $D_i=D_{INI}$ (where i is the nozzle number of 1, 2, 3, 4 or 5, and $D_{INI}$ is a uniform value), the origin O is set at the ideal depositing position of the nozzle NZ3, and the depositing position of each of the nozzles NZ1 to NZ5 is $X_i$.

Here, $D_i$ represents the output optical density of the nozzle when averaged physically in the recording medium conveyance direction, and corresponds to the average of the density data D(i, j) of pixels (where i is the nozzle number, and j is the pixel number in the conveyance direction of the recording medium) taken with respect to "j" in the data processing.

As shown in FIG. 3, the depositing position error of the nozzle NZ3 is represented by the divergence from the origin point 0 of the density output of the nozzle NZ3 (thick line). Here, the correction of this divergence in the output density is considered.

Figure 4:
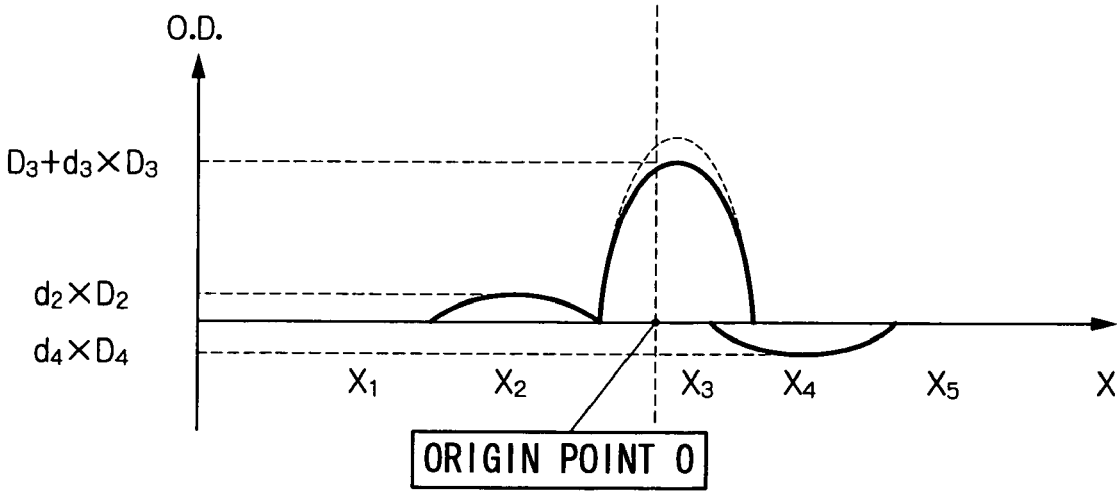
FIG. 4 is an illustrative diagram showing a state after correction of density non-uniformity according to an embodiment of the present invention.

FIG. 4 is a diagram of a mode after correction. Here, only the correction components are shown for the nozzles other than the nozzle NZ3. In the case of FIG. 4, the number of nozzles used in correction is N=3, and density correction coefficients d2, d3 and d4 are applied to the nozzles NZ2, NZ3 and NZ4, respectively. The density correction coefficients $d_i$ described here are defined as $D'_i=D_i+d_i\times D_i$, where $D'_i$ are the output densities after correction.

In the present embodiment, the density correction coefficient $d_i$ of each nozzle is specified so as to minimize the visibility of the density non-uniformity. Density non-uniformities in the print image are represented by the intensities in the spatial frequency characteristics (power spectrum). Since the characteristics of human vision mean that high-frequency components are not readily visible, the visibility of density non-uniformity corresponds to the low-frequency component of the power spectrum. In this case, the density correction coefficient $d_i$ for each nozzle is specified so as to minimize the low-frequency component of the power spectrum.

The details of the derivation of the equation for specifying the density correction coefficient $d_i$ are described later, but to state the result in advance, the density correction coefficient $d_i$ corresponding to the depositing position error of a particular nozzle (correction object nozzle) is specified by means of the following equation:

$$d_i = \begin{cases} \dfrac{\prod_k x_k}{x_i \cdot \prod_{k \neq i} (x_k - x_i)} - 1 & \text{(for the correction object nozzle)} \\ \dfrac{\prod_k x_k}{x_i \cdot \prod_{k \neq i} (x_k - x_i)} & \text{(for nozzles other than the correction object nozzle),} \end{cases} \tag{3}$$

where $x_i$ is the depositing position of each nozzle, taking the origin at the ideal depositing position of the correction object nozzle. In the present embodiment, "Xbi" shown in FIGS. 1 and 2 corresponds to this depositing position. Π in equation (3) means that the product is found for the N nozzles used for correction. When stated explicitly for the case of N=3 in FIG. 4, the following equations are derived:

$$d_2 = \frac{x_2 \cdot x_3 \cdot x_4}{x_2 \cdot (x_3 - x_2) \cdot (x_4 - x_2)}; \tag{4}$$

$$d_3 = \frac{x_2 \cdot x_3 \cdot x_4}{x_3 \cdot (x_2 - x_3) \cdot (x_4 - x_3)} - 1; \text{ and} \tag{5}$$

$$d_4 = \frac{x_2 \cdot x_3 \cdot x_4}{x_4 \cdot (x_2 - x_4) \cdot (x_3 - x_4)}. \tag{6}$$

Calculation of Density Correction Coefficients

It is possible to logically derive the density correction coefficient for each nozzle from the conditions for minimizing the low-frequency component of the power spectrum of the density non-uniformity.

Firstly, a density profile D(x) incorporating the error characteristics of each nozzle is defined as:

$$D(x) = \sum_i D_i \cdot z(x - x_i), \tag{7}$$

where i is the nozzle number, x is the positional coordinate on the medium (in the nozzle column direction), $D_i$ is the nozzle output density (the height of peak), z(x) is the standard density profile (where x=0 is the center of gravity), and $x_i = \bar{x}_i + \Delta x_i$ is the depositing position of the i-th nozzle (the ideal position+the error).

The density profile D(x) of the image is the sum of the density profiles printed by the nozzles, and the print model represents the printing performed by each nozzle (the density profile printed by each nozzle). The print model is represented separately by the nozzle output density $D_i$ and the standard density profile z(x).

The standard density profile z(x) has a limited spread equal to the dot diameter in strict terms, but if the correction of positional errors is considered to be a problem of balancing divergences in the density, then the important element is the central position (depositing position) of the density profile and the spread of the density profile is a secondary factor. Hence, an approximation that converts the profile by means of a δ function is appropriate. When a standard density profile represented with a δ function is supposed, then an arithmetical treatment can be achieved readily, and a precise solution for the correction coefficients can be obtained.

Figure 5:
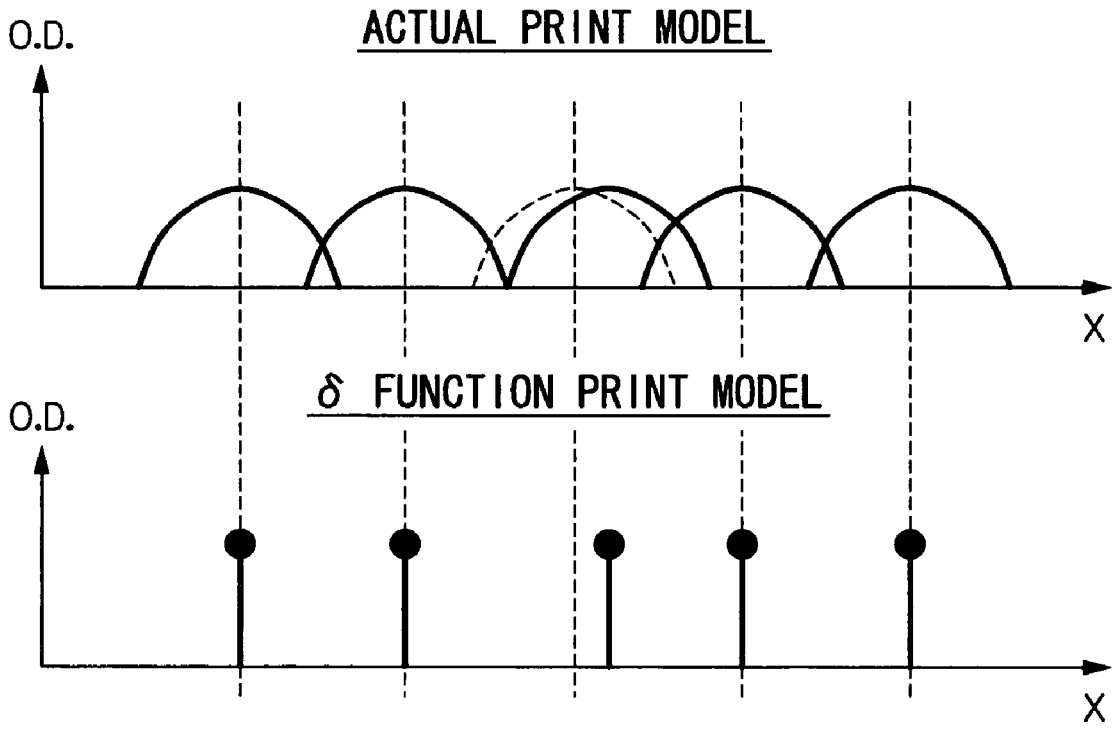
FIG. 5 is a diagram showing graphs of density profiles of an actual print model and of a δ function of print model.

FIG. 5 shows a graph of density profiles of an actual print model and a δ function type of print model. The standard density profile is represented as approximation using the δ function model as:

$$z(x - x_i) = \delta(x - x_i). \tag{8}$$

In calculating the correction coefficients, it is considered that the depositing position error $\Delta x_0$ of a particular nozzle (i=0) is to be corrected by means of the N pieces of nozzles including the particular nozzle and the nozzles surrounding the particular nozzle. Here, the number of the nozzle to be corrected is i=0. Attention is paid to the fact that each of the surrounding nozzles may also have a prescribed depositing position error.

The numbers (indexes) of the N nozzles including the nozzle to be corrected (central nozzle) are represented as:

$$\text{Nozzle index: } i = -\frac{N-1}{2}, \ldots, -1, 0, 1, \ldots, \frac{N-1}{2}. \tag{9}$$

The number N must be an odd number in this expression, but in implementing the present invention, the number N is not necessarily limited to being an odd number.

The initial output density (the output density before correction) has a value only if i=0, and is represented as follows:

$$D_i = \begin{cases} D_{INI} & (i = 0) \\ 0 & (i \neq 0) \end{cases}. \tag{10}$$

When the density correction coefficients are $d_i$, then the output densities $D'_i$ after correction are represented as follows:

$$D_i' = D_i + d_i \times D_{INI} = d_i' \times D_{INI}, \quad (11)$$

$$\text{where } d_i' = \begin{cases} d_i + 1 & (i = 0) \\ d_i & (i \neq 0) \end{cases}.$$

In other words, when i=0, the corrected output density is the sum of the initial output density value and the correction value ($d_i \times D_{INI}$), and when $i \neq 0$, the corrected output density is equal to the correction value only.

The depositing position $x_i$ of each nozzle i is represented as:

$$x_i = \bar{x}_i + \Delta x_i \quad (12)$$

where $\bar{x}_i$ is the ideal depositing position, $\Delta x_i$ is the depositing position error, and the ideal depositing position of the correction object nozzle is set as the origin ($\bar{x}_0 = 0$).

When using a δ function type of print model, the density profile after correction is expressed as follows:

$$D(x) = \sum_{i=-(N-1)/2}^{i=(N-1)/2} D_i' \cdot \delta(x - x_i) = D_{INI} \cdot \sum_{i=-(N-1)/2}^{i=(N-1)/2} d_i' \cdot \delta(x - x_i). \quad (13)$$

By Fourier transform on this equation, the following equation is obtained:

$$\begin{aligned} T(f) &= \int_{-\infty}^{\infty} D(x) \cdot e^{ifx} dx \\ &= \sum_i d_i' \cdot \int_{-\infty}^{\infty} \delta(x - x_i) \cdot e^{ifx} dx \\ &= \sum_i d_i' \cdot e^{ifx_i}, \end{aligned} \quad (14)$$

where $D_{INI}$ is omitted since it is a common constant.

Minimizing the visibility of density non-uniformities means minimizing the low-frequency components of the power spectrum expressed as:

$$\text{Power spectrum} = \int T(f)^2 df. \quad (15)$$

This can be approximated arithmetically by taking the differential coefficients (of the first-order, the second-order, . . . ) for f=0 in T(f) to be zero. Since there are N unknown numbers $d'_i$, then if conditions are used where the differential coefficients up to the (N−1)-th order are zero, and also including the condition for maintaining the direct current (DC) component, then all (N) of the unknown numbers $d'_i$ can be specified precisely. Thus, the following correction conditions are specified:

$$\text{DC component: } T(f=0)=1 \text{ (condition for preserving the DC component);} \quad (16)$$

$$\text{First-order coefficient } \frac{d}{df} T(f = 0) = 0; \quad (17)$$

$$\text{Second-order coefficient } \frac{d^2}{df^2} T(f = 0) = 0; \quad (18)$$

$$\ldots$$

$$(N-1)\text{-th order coefficient } \frac{d^{N-1}}{df^{N-1}} T(f = 0) = 0. \quad (19)$$

In the δ function model, when the correction conditions are developed, N simultaneous equations relating to Di are reached by means of a simple calculation. When the correction conditions are rearranged, the following group of conditions (group of equations) is obtained:

$$\Sigma d_i' = 1; \quad (20)$$

$$\Sigma x_i d_i' = 0; \quad (21)$$

$$\Sigma x_i^2 d_i' = 0; \quad (22)$$

$$\Sigma x_i^{N-1} d_i' = 0. \quad (23)$$

The meaning of this group of equations is that the first equation represents the preservation of the DC component and the second equation represents the preservation of the central position. The third and subsequent equations represent the fact that the (N−1)-th moment in the statistical calculation is zero.

The conditional equations thus obtained can be represented with a matrix format as follows:

$$\begin{pmatrix} 1 & \cdots & 1 & \cdots & \cdots & 1 \\ x_{-(N-1)/2} & \cdots & x_0 & \cdots & \cdots & x_{(N-1)/2} \\ x_{-(N-1)/2}^2 & \cdots & x_0^2 & & \cdots & x_{(N-1)/2}^2 \\ \vdots & & & \ddots & & \vdots \\ \vdots & & & & \ddots & \vdots \\ x_{-(N-1)/2}^{N-1} & \cdots & x_0^{N-1} & \cdots & \cdots & x_{(N-1)/2}^{N-1} \end{pmatrix} \begin{pmatrix} d'_{-(N-1)/2} \\ \vdots \\ \vdots \\ d'_0 \\ \vdots \\ d'_{(N-1)/2} \end{pmatrix} = \begin{pmatrix} 1 \\ 0 \\ \vdots \\ 0 \\ \vdots \\ 0 \end{pmatrix}. \quad (24)$$

This coefficient matrix A is a so-called Vandermonde matrix, and it is known that this matrix equation can be converted to the following equation, by using the product of the differences:

$$|A| = \prod_{j>k} (x_j - x_k). \quad (25)$$

It is hence possible to determine the precise solution of $d'_i$ using the Crammer's formula. The detailed sequence of the calculation is omitted here, but by means of algebraic calculation, the following solution is obtained:

$$d_i' = \frac{\prod_k x_k}{x_i \cdot \prod_{k \neq i} (x_k - x_i)}. \quad (26)$$

Therefore, the correction coefficients $d_i$ are determined as follows:

$$d_i = \begin{cases} \dfrac{\prod_k x_k}{x_i \cdot \prod_{k \neq i} (x_k - x_i)} - 1 & (i = 0) \\ \dfrac{\prod_k x_k}{x_i \cdot \prod_{k \neq i} (x_k - x_i)} & (i \neq 0) \end{cases}. \quad (27)$$

Thus, the precise solution for the density correction coefficients $d_i$ is found, from the conditions where the differential coefficients at the origin of the power spectrum become zero. As the number of nozzles N used in the correction increases, the possibility of making the higher-order differential coefficients become zero increases, and hence, the low-frequency energy becomes smaller and the visibility of non-uniformities is reduced yet further.

In the present embodiment, the conditions where the differential coefficients become zero are used, but if the differential coefficients become sufficiently small values compared to the differential coefficients before the correction (such as 1/10 of the values before the correction), rather than being set completely to zero, it is still possible to reduce non-uniformity.

Results of Correction Using the Above-Described Density Correction Coefficients

Figure 6:
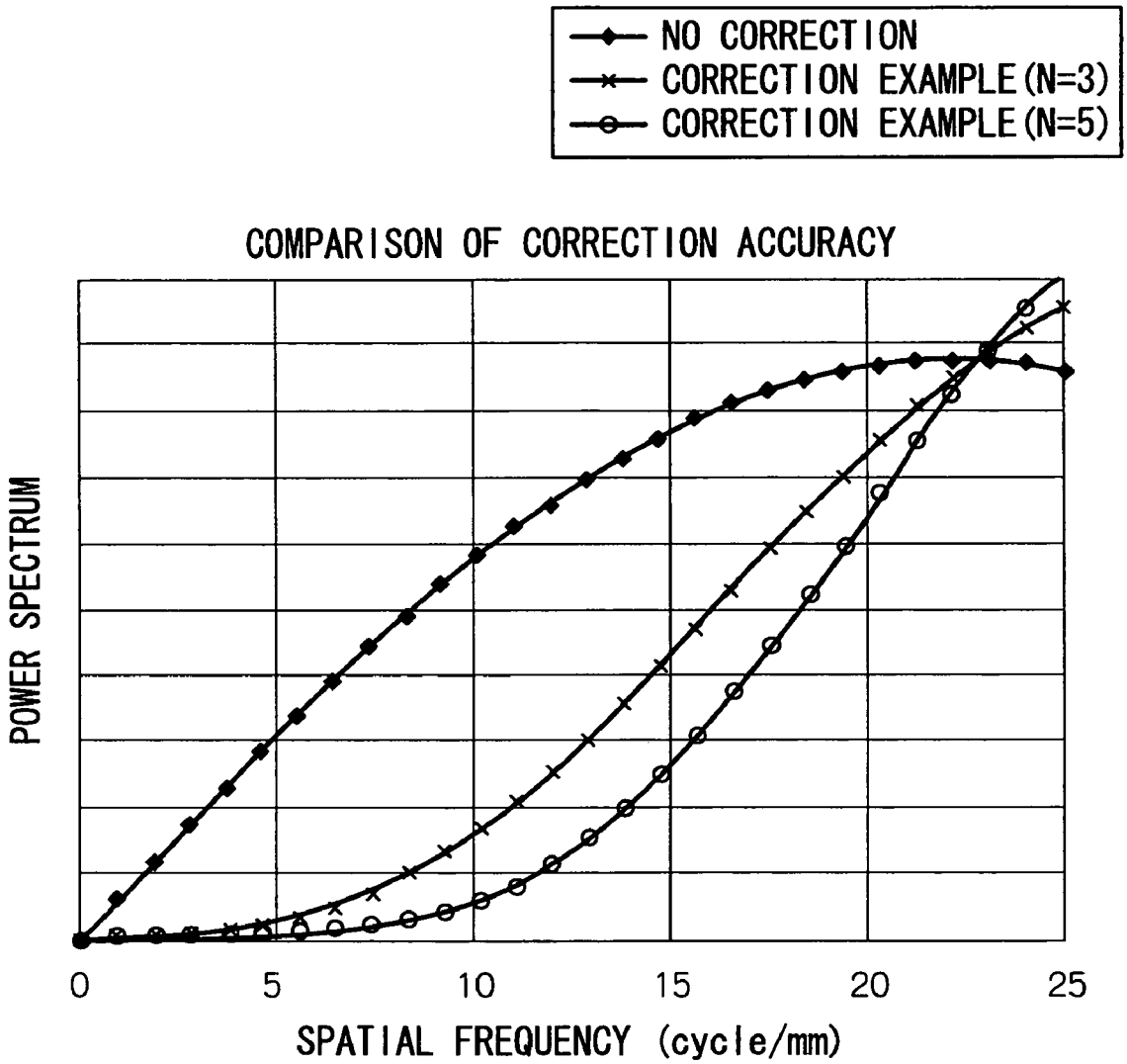
FIG. 6 is a graph of a power spectrum showing the results of correction according to an embodiment of the present invention.

FIG. 6 shows the spatial frequency characteristics (power spectra) after correction for a nozzle having the depositing position error shown in FIG. 3. FIG. 6 shows a correction example 1 when N=3 according to the embodiment of the present invention; and a correction example 2 when N=5 according to the embodiment of the present invention. The common conditions used in the calculations are that: the dot density is 1200 dots per inch (dpi); the diameter of the deposited dot is 32 μm; and the nozzle position error (depositing position error) is 10 μm.

If the human visual characteristics are taken into account, then the visibility of the density non-uniformity is represented by the power spectrum in the low-frequency region of the spatial frequency of 0 cycle/mm to 8 cycle/mm, and the smaller the power spectrum in this region, the greater the correction accuracy.

Figure 7:
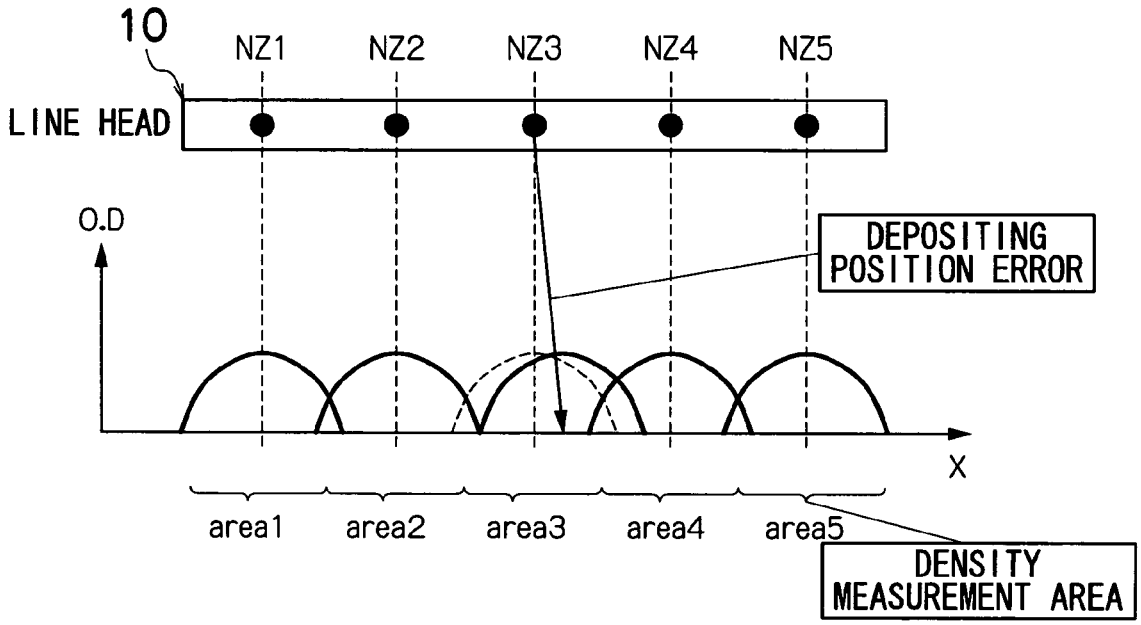
FIG. 7 is an illustrative diagram showing an example of a density profile before correction.

The correction example 1 (N=3) according to the embodiment of the present invention shows a case where the power spectrum is substantially zero in the region of 0 cycle/mm to 5 cycle/mm, and a suitable correction effect is obtained in comparison with a case where there is no correction. Furthermore, in the correction example 2 (N=5) according to the embodiment of the present invention, the power spectrum is further reduced in comparison with the correction example 1 (N=3). Therefore, the greater the number of nozzles N used in correction, the greater the improvement in the correction effect. In the case of the present embodiment shown in FIG. 3, as shown in FIG. 7, although the output density of the nozzle NZ3 to be corrected does not project physically into AR1 and AR5, it is possible further to reduce the power spectrum by using the nozzles NZ1 and NZ5 for correction as well.

Figure 8:
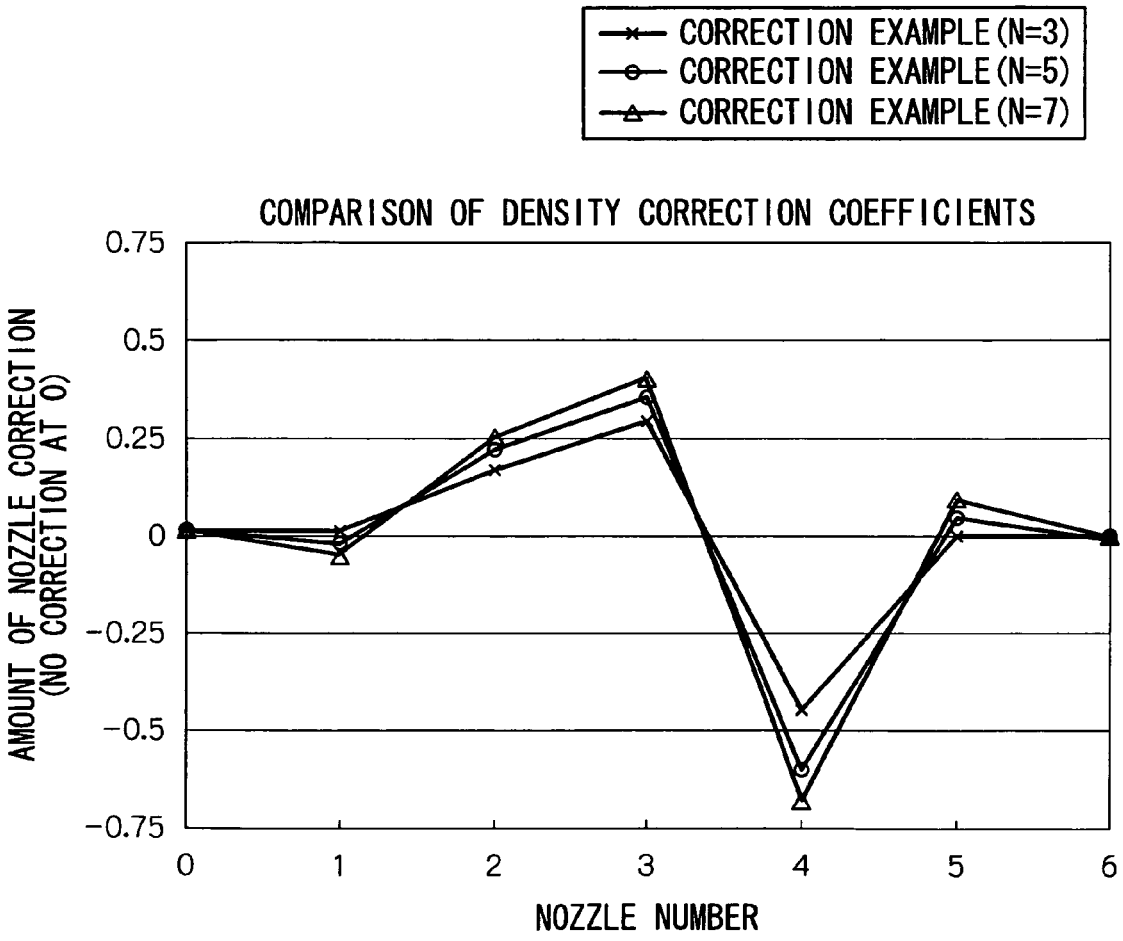
FIG. 8 is a graph used to describe the relationship between the number of nozzles (N) used for correction, and the density correction coefficient.

FIG. 8 shows a comparison of the density correction coefficients of the correction examples 1 to 3 for different numbers of nozzles used in correction. The correction accuracy improves as the value of N increases, as revealed by a comparison between the correction example 1 when N=3 according to the embodiment of the present invention, the correction example 2 when N=5 according to the embodiment of the present invention, and the correction example 3 when N=7 according to the embodiment of the present invention, but the range of the change in the density correction coefficients also increases. Furthermore, naturally, as the depositing position error of the nozzles increases, the range of the change in the density correction coefficients also increases.

If the density correction coefficient increases over a certain value, then this is undesirable since there is a possibility that the reproducibility of the input image is disrupted. Therefore, a greater than necessary increase in the N value is not desirable. Desirably, an optimal N value is set by taking account of both correction accuracy and image reproducibility. In the case of each of the correction examples 1 to 3 for N=3 to 7 shown in FIG. 8, the (absolute value of the) amount of change in the density correction coefficient is relatively small, and therefore density non-uniformities can be corrected without disrupting the reproduction of the input image.

The foregoing description relates to the method of specifying density correction coefficients relating to one particular nozzle (e.g., the nozzle NZ3 in FIG. 3). In actual practice, all of the nozzles in the head have some degree of depositing position errors, and therefore, it is desirable that corrections are performed in respect of all of these depositing position errors.

In other words, the aforementioned density correction coefficients for the surrounding N nozzles are determined with respect to every nozzle. Since the equations for minimizing the power spectra, which are described later and used when specifying the density correction coefficients, are linear, then it is possible to superpose the equations for each nozzle. Therefore, the total density correction coefficient for a nozzle is determined by finding the sum of the density correction coefficients obtained as described above.

More specifically, if the density correction coefficient for a nozzle i in relation to the positional error of a nozzle k is set to be d(i, k), then the value of this d(i, k) is determined by the above-described equation (3), and the total density correction coefficient $d_i$ for the nozzle i is obtained by linear combination of d(i, k) as follows:

$$d_i = \sum_k d(i, k). \tag{28}$$

In this embodiment, d(i, k) are accumulated for the index k assuming that the depositing position errors of all of the nozzles are to be corrected, but it is also possible to adopt a composition in which a certain value ΔX_thresh is set previously as a threshold value, and correction is performed selectively by setting as objects for correction only those nozzles that have a depositing position error exceeding this threshold value.

As stated above, the accuracy of correction is improved if the value of the number of nozzles N used for the correction is increased, but this also increases the breadth of change of the density correction coefficients and may lead to disruption of the reproduced image. Therefore, desirably, a limit range (a lower limit d_min to an upper limit d_max) is set for the correction coefficients in order to prevent the occurrence of image disruption, and the value N is set in such a manner that the total density correction coefficient determined by the above-described equation (28) comes within this limit range. In other words, the value N is set in such a manner that the relationship of $d_min < d_i < d_max$ is satisfied.

From experimental observation, it is known that image disruption does not occur provided that $d_min \geqq -1$ and $d_max \leqq 1$.

Image Processing Sequence

Figure 9:
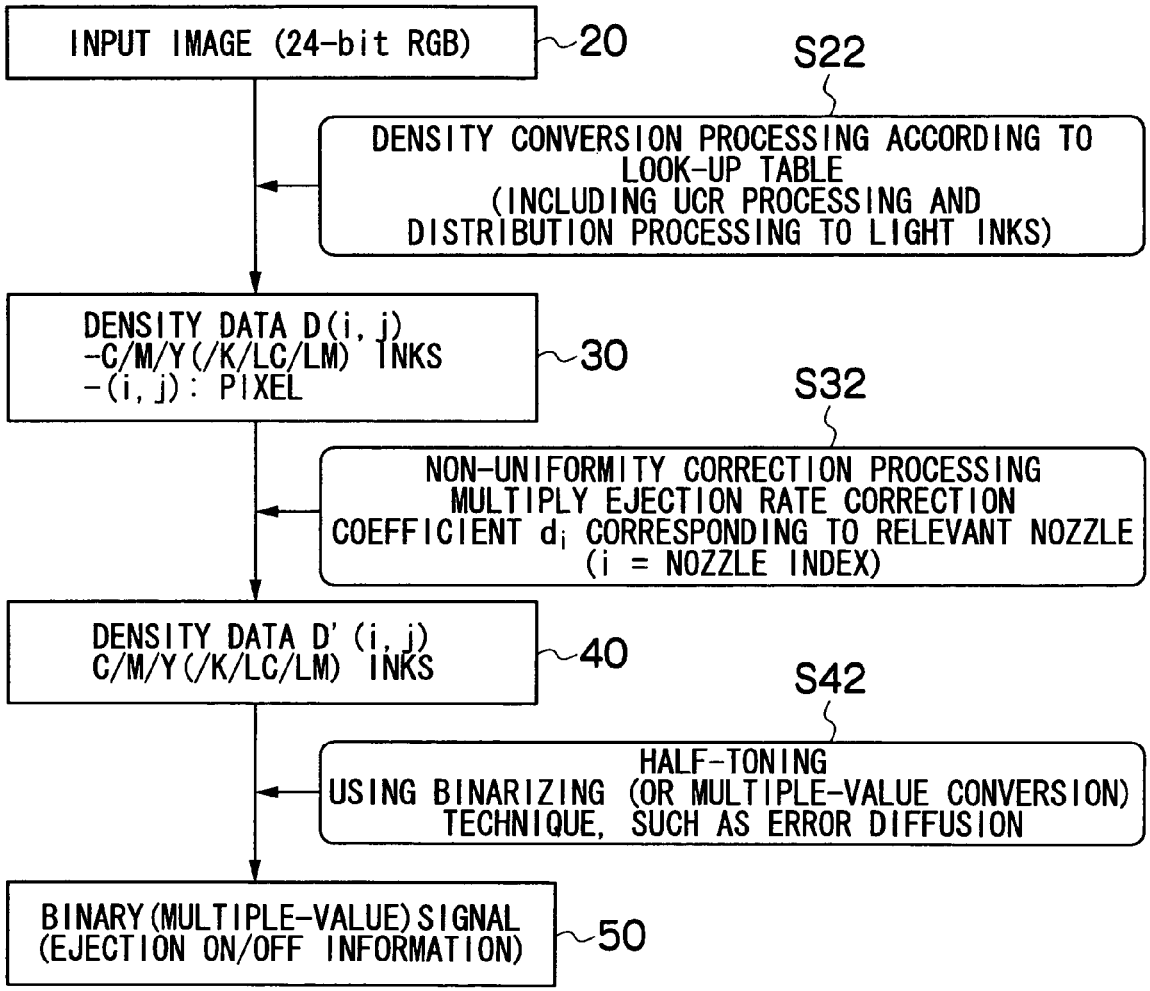
FIG. 9 is a flowchart showing the sequence of image processing according to an embodiment of the present invention.

An image processing sequence which incorporates the non-uniformity correction processing according to the present embodiment is shown in FIG. 9.

For example, the input image 20 of 24-bit RGB data is inputted, but there are no particular restrictions on the data format of the input image 20. Density conversion processing based on a look-up table is carried out on this input image 20 (step S22), thereby converting the input image into density data D(i, j) corresponding to the ink colors of the printers. Here, (i, j) indicates the position of a pixel, and hence the density data is assigned to each of pixels.

In this case, is it supposed that the image resolution of the input image 20 matches the image resolution (nozzle resolution) of the printer. If the image resolution of the input image does not match the image resolution (nozzle resolution) of the printer, then pixel number conversion processing is carried out on the input image, in accordance with the resolution of the printer.

The density conversion processing in step S22 uses a general process, which includes under color removal (UCR) processing, light ink distribution processing in the case of a system which uses light inks (light-colored inks of the same color), and so on.

For example, in the case of the printer having a three-ink composition comprising cyan (C), magenta (M) and yellow (Y), the image is converted into CMY density data D(i, j). Alternatively, in the case of the printer having a system which also uses other inks, such as black (K), light cyan (LC), and light magenta (LM) in addition to the three inks of CMY, then the image is converted into density data D(i, j) including these additional ink colors.

Non-uniformity correction processing is carried out with respect to the density data D(i, j) obtained by the density conversion processing (denoted with reference numeral 30 in FIG. 9) (step S32). Here, a calculation is performed in order to multiply the density correction coefficient (ejection rate correction coefficient) $d_i$ corresponding to the related nozzle, by the density data D(i, j).

Figure 10:
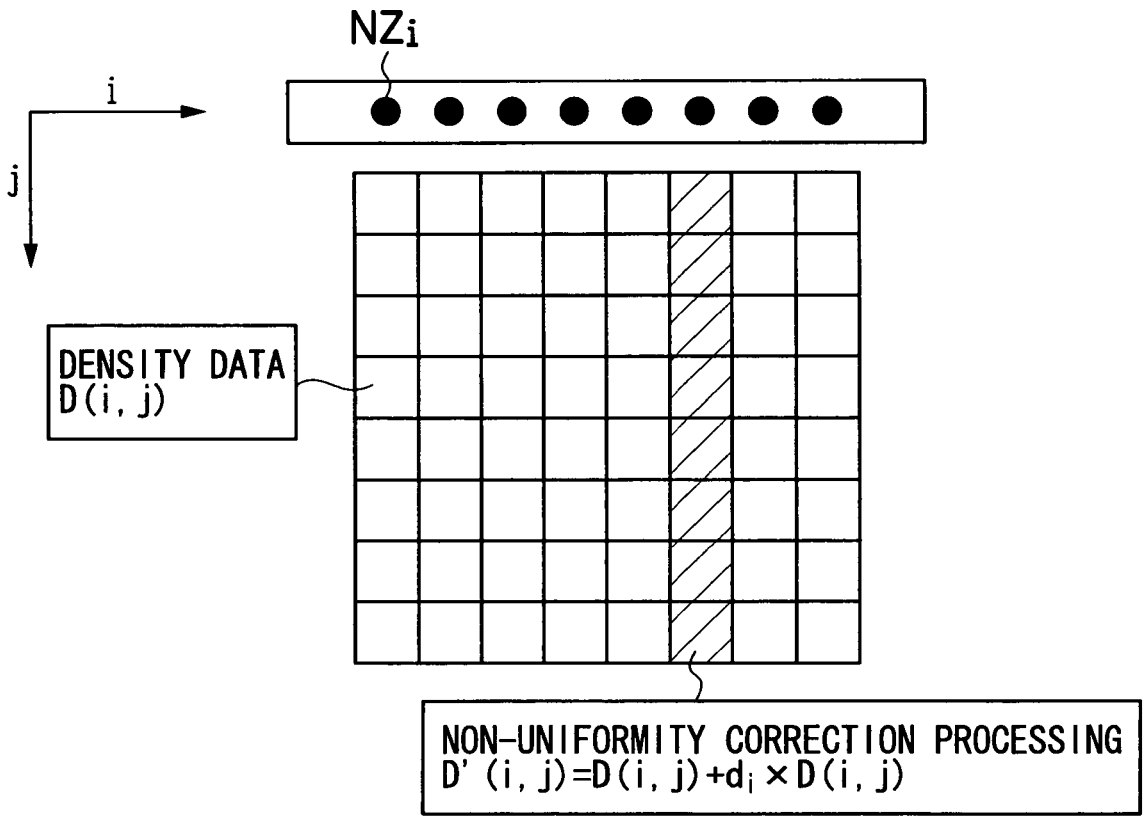
FIG. 10 is a conceptual diagram of density non-uniformity correction processing according to an embodiment of the present invention.

As shown in the schematic drawing in FIG. 10, the pixel position (i, j) on the image is specified by the position (main scanning direction position) i of the nozzle $NZ_i$, and a sub-scanning direction position j, and the density data D(i, j) is assigned to each of the pixels. If non-uniformity correction processing is carried out for the nozzle that ejects droplets to form the pixel column indicated by the shading in FIG. 10, then the density data D'(i, j) after correction can be calculated by the following equation:

$$D'(i,j)=D(i,j)+d_i \times D(i,j). \tag{29}$$

The corrected density data D'(i,j) is thus obtained.

By applying a half-toning process to the corrected density data D'(i, j) (denoted with reference numeral 40 in FIG. 9) (step S42), the data is converted into dot on/off signals (in binary data), or alternatively, if the dot sizes are variable, then the data is converted into multiple-value data signals including the size types (selection of dot size). There are no particular restrictions on the half-toning method used, and a commonly known binarizing (or multiple-value converting) technique, such as error diffusion, dithering, or the like, may be used.

Ink ejection (droplet ejection) data for each nozzle is generated on the basis of the binary (or multiple-value) signals thus obtained (denoted with reference numeral 50 in FIG. 9), and the ejection operation is controlled accordingly. Thus, density non-uniformities are suppressed and images of high quality can be formed.

Figure 11:
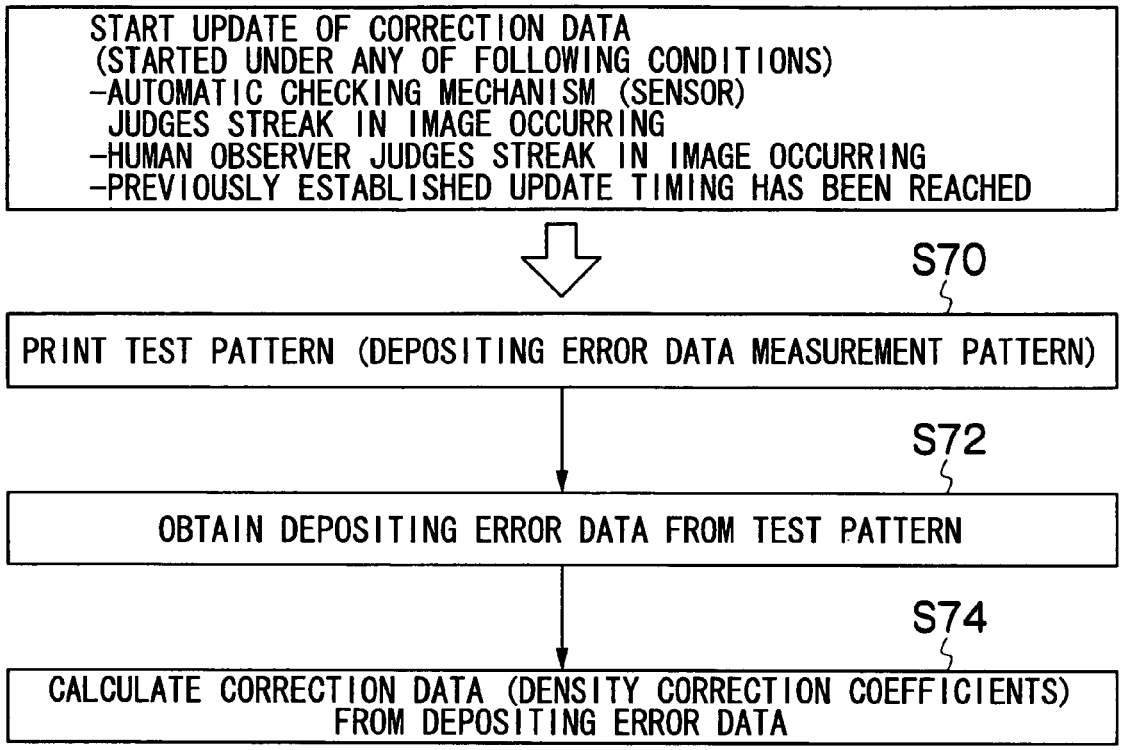
FIG. 11 is a flowchart showing a sequence of processing for updating the correctional data.

FIG. 11 is a flowchart showing an embodiment of a process for updating the density correction coefficients (correction data). The correction data updating process starts when one of the following conditions applies, for instance.

Namely, the update processing starts if either: (a) an automatic checking device (sensor), which monitors the print result, judges that a non-uniformity streak has occurred in the printed image; or (b) a human observer judges that a non-uniformity streak has occurred in the printed image upon looking at the printed image, and performs a prescribed operation (such as inputting a command to start the updating process); or (c) a previously established update timing has been reached (the update timing can be set and judged by means of time management based on a timer, or the like, or operational record management based on a print counter).

When the update process starts, firstly, a test pattern for obtaining depositing error data (a prescribed pattern which is determined previously) is printed (step S70).

Next, the depositing error data is obtained on the basis of the print result of the test pattern (step S72). For this obtainment of the depositing error data, it is possible to use an image reading device having an image sensor (imaging elements) (including a signal processing device for processing the captured image signal). The depositing error data includes, for example, information on depositing position error, information on optical density information, and the like.

The correction data (density correction coefficients) is calculated from the depositing error data obtained at step S72 (step S74). The method of calculating the density correction coefficients is as described above.

The information relating to the density correction coefficients thus derived is stored in a rewriteable storage device, such as an EEPROM (electronically erasable and programmable read only memory), and subsequently, the most recent correction coefficients are used.

Composition of Inkjet Recording Apparatus

Next, an inkjet recording apparatus is described as a concrete embodiment of the application of an image recording apparatus having the density non-uniformity correction function described above.

Figure 12:
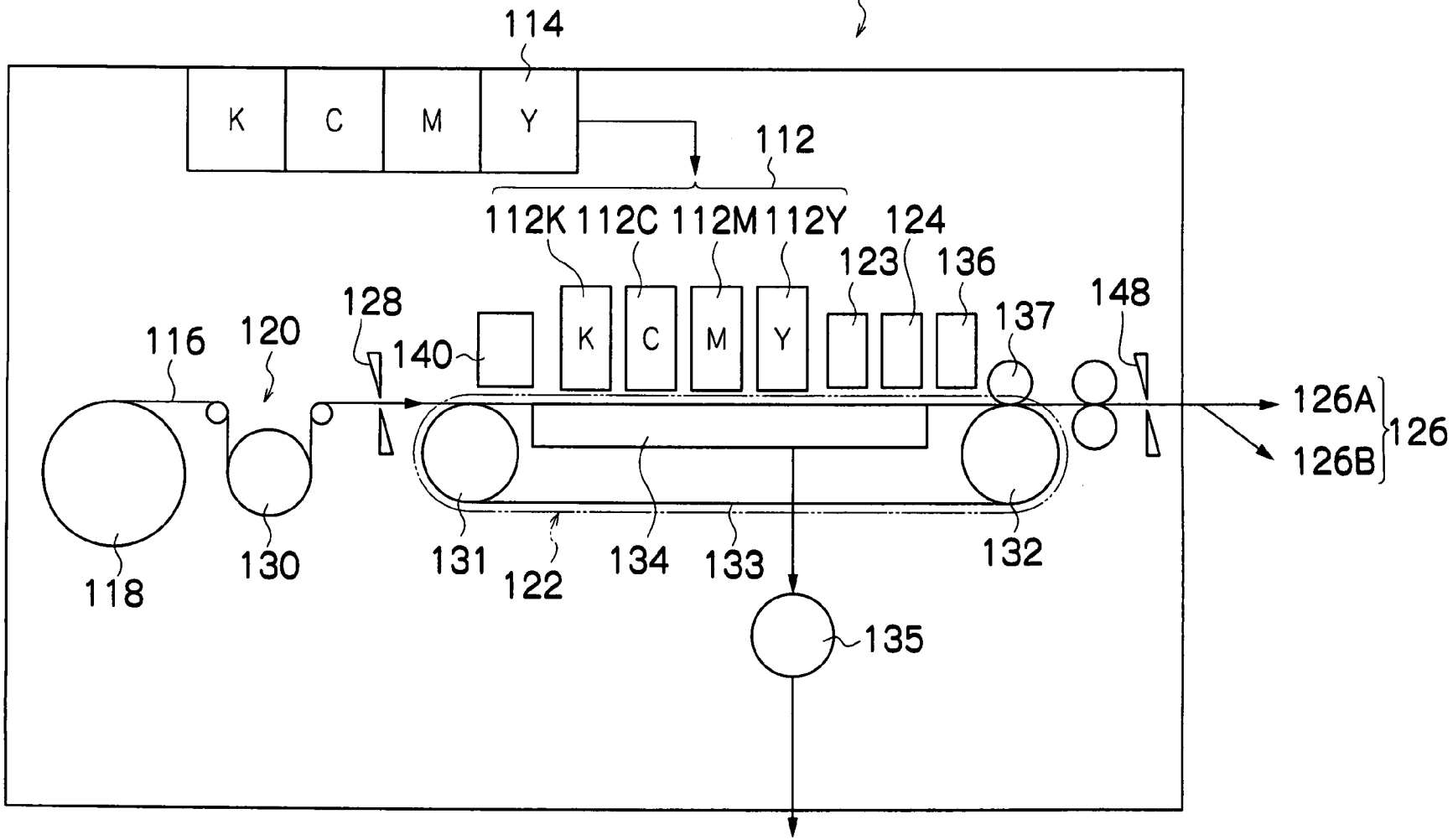
FIG. 12 is a general schematic drawing of an inkjet recording apparatus showing one embodiment of an image recording apparatus relating to the present invention.

FIG. 12 is a general schematic drawing of an inkjet recording apparatus 110, which forms one embodiment of an image recording apparatus according to the present invention. As shown in FIG. 12, the inkjet recording apparatus 110 comprises: a print unit 112 having a plurality of inkjet recording heads (hereinafter referred to as heads) 112K, 112C, 112M, and 112Y provided for ink colors of black (K), cyan (C), magenta (M), and yellow (Y), respectively; an ink storing and loading unit 114 for storing inks to be supplied to the heads 112K, 112C, 112M and 112Y; a paper supply unit 118 for supplying recording paper 116 forming a recording medium; a decurling unit 120 for removing curl in the recording paper 116; a belt conveyance unit 122, disposed facing the nozzle face (ink ejection face) of the print unit 112, for conveying the recording paper 116 while keeping the recording paper 116 flat; a distance measurement unit 123 which measures the distance to the recording surface; a print determination unit 124 for reading the printed result produced by the print unit 112; and a paper output unit 126 for outputting the recorded recording paper (printed matter) to the exterior.

The ink storing and loading unit 114 has ink tanks for storing the inks of K, C, M and Y to be supplied to the heads 112K, 112C, 112M, and 112Y, and the tanks are connected to the heads 112K, 112C, 112M, and 112Y by means of prescribed channels. The ink storing and loading unit 114 has a warning device (for example, a display device or an alarm sound generator) for warning when the remaining amount of any ink is low, and has a mechanism for preventing loading errors among the colors.

In FIG. 12, a magazine for rolled paper (continuous paper) is shown as an embodiment of the paper supply unit 118; however, more magazines with paper differences such as paper width and quality may be jointly provided. Moreover, papers may be supplied with cassettes that contain cut papers loaded in layers and that are used jointly or in lieu of the magazine for rolled paper.

In the case of a configuration in which a plurality of types of recording media can be used, it is preferable that an information recording medium such as a bar code and a wireless tag containing information about the type of recording medium is attached to the magazine, and by reading the information contained in the information recording medium with a predetermined reading device, the type of recording medium to be used is automatically determined, and ink-droplet ejection is controlled so that the ink-droplets are ejected in an appropriate manner in accordance with the type of medium.

The recording paper 116 delivered from the paper supply unit 118 retains curl due to having been loaded in the magazine. In order to remove the curl, heat is applied to the recording paper 116 in the decurling unit 120 by a heating drum 130 in the direction opposite from the curl direction in the magazine. The heating temperature at this time is preferably controlled so that the recording paper 116 has a curl in which the surface on which the print is to be made is slightly round outward.

In the case of the configuration in which roll paper is used, a cutter (first cutter) 128 is provided as shown in FIG. 12, and the continuous paper is cut into a desired size by the cutter 128. When cut papers are used, the cutter 128 is not required.

The decurled and cut recording paper 116 is delivered to the belt conveyance unit 122. The belt conveyance unit 122 has a configuration in which an endless belt 133 is set around rollers 131 and 132 so that the portion of the endless belt 133 facing at least the nozzle face of the printing unit 112 and the sensor face of the print determination unit 124 forms a horizontal plane (flat plane).

The belt 133 has a width that is greater than the width of the recording paper 116, and a plurality of suction apertures (not shown) are formed on the belt surface. Furthermore, in the case of a composition in which a test pattern for measuring the amount of depositing position displacement is recorded directly onto the belt 133, a region for printing the test pattern is provided on the belt 133.

A suction chamber 134 is disposed in a position facing the sensor surface of the print determination unit 124 and the nozzle surface of the printing unit 112 on the interior side of the belt 133, which is set around the rollers 131 and 132, as shown in FIG. 12. The suction chamber 134 provides suction with a fan 135 to generate a negative pressure, and the recording paper 116 is held on the belt 133 by suction. In place of the suction system, an electrostatic attraction system can be employed.

The belt 133 is driven in the clockwise direction in FIG. 12 by the motive force of a motor 188 (not shown in FIG. 12, but shown in FIG. 17) being transmitted to at least one of the rollers 131 and 132, which the belt 133 is set around, and the recording paper 116 held on the belt 133 is conveyed from left to right in FIG. 12.

If the test pattern for measuring the amount of depositing position displacement is printed onto a prescribed region on the belt 133 (teat pattern printing region), or if a borderless print, or the like, is performed, then ink is also deposited on the belt 133. Therefore, a belt cleaning unit 136 is provided at a prescribed position outside the print region, as a cleaning device on the belt 133. In the example shown in FIG. 12, the belt cleaning unit 136 is provided after the print determination unit 124 and before the conveyance roller 137. Although the details of the configuration of the belt-cleaning unit 136 are not shown, embodiments thereof include a configuration in which the belt is nipped with cleaning rollers such as a brush roller and a water absorbent roller, an air blow configuration in which clean air is blown onto the belt 133, or a combination of these. In the case of the configuration in which the belt 133 is nipped with the cleaning rollers, it is preferable to make the line velocity of the cleaning rollers different than that of the belt 133 to improve the cleaning effect.

The inkjet recording apparatus may comprise a roller nip conveyance mechanism, instead of the belt conveyance unit 122. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 140 is disposed on the upstream side of the printing unit 112 in the conveyance pathway formed by the belt conveyance unit 122. The heating fan 140 blows heated air onto the recording paper 116 to heat the recording paper 116 immediately before printing so that the ink deposited on the recording paper 116 dries more easily.

Figure 13:
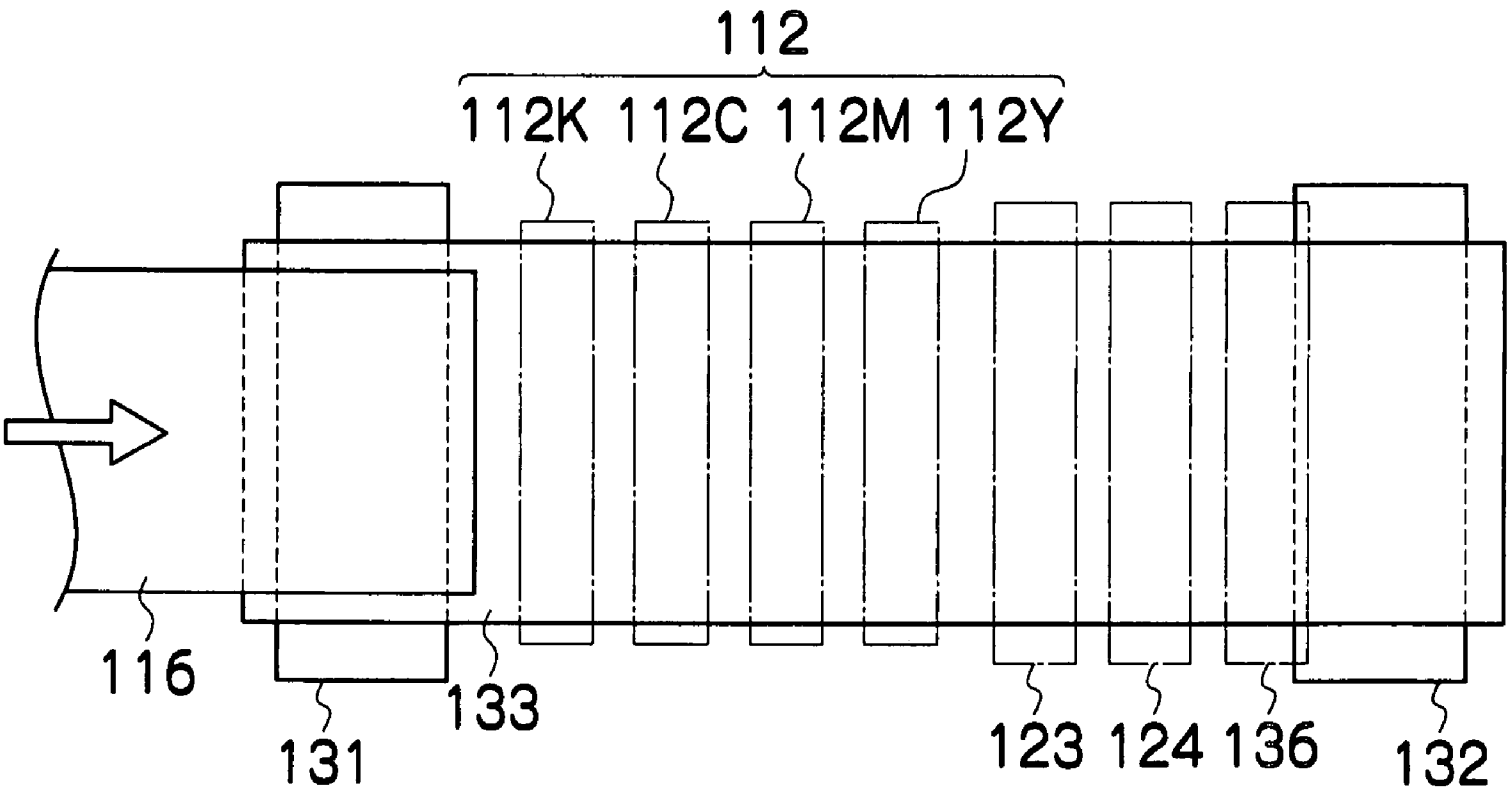
FIG. 13 is a principal plan diagram of the peripheral area of a print unit in the inkjet recording apparatus illustrated in FIG. 12.

The heads 112K, 112C, 112M and 112Y of the printing unit 112 are full line heads having a length corresponding to the maximum width of the recording paper 116 used with the inkjet recording apparatus 110, and comprising a plurality of nozzles for ejecting ink arranged on a nozzle face through a length exceeding at least one edge of the maximum-size recording medium (namely, the full width of the printable range) (see FIG. 13).

The print heads 112K, 112C, 112M and 112Y are arranged in this color order (black (K), cyan (C), magenta (M), yellow (Y)) from the upstream side in the feed direction of the recording paper 116, and these heads 112K, 112C, 112M and 112Y are fixed extending in a direction substantially perpendicular to the conveyance direction of the recording paper 116.

A color image can be formed on the recording paper 116 by ejecting inks of different colors from the heads 112K, 112C, 112M and 112Y, respectively, onto the recording paper 116 while the recording paper 116 is conveyed by the belt conveyance unit 122.

By adopting a configuration in which the full line heads 112K, 112C, 112M and 112Y having nozzle rows covering the full paper width are provided for the respective colors in this way, it is possible to record an image on the full surface of the recording paper 116 by performing just one operation of relatively moving the recording paper 116 and the printing unit 112 in the paper conveyance direction (the sub-scanning direction), in other words, by means of a single sub-scanning action. Higher-speed printing is thereby made possible and productivity can be improved in comparison with a shuttle type head configuration in which a recording head reciprocates in the main scanning direction.

Although the configuration with the KCMY four standard colors is described in the present embodiment, combinations of the ink colors and the number of colors are not limited to those. Light inks, dark inks or special color inks can be added as required. For example, a configuration is possible in which inkjet heads for ejecting light-colored inks such as light cyan and light magenta are added. Furthermore, there are no particular restrictions of the sequence in which the heads of respective colors are arranged.

The distance measurement unit 123 shown in FIG. 12 is a device which measures the distance to the recording surface by means of a pulse laser, and acquires the distance information between the nozzle surfaces of the heads 112K, 112C, 112M and 112Y and the recording surface on the basis of these measurement results.

The print determination unit 124 has an image sensor (line sensor or area sensor) for capturing an image of the droplet ejection result of the print unit 112, and functions as a device to check the ejection characteristics, such as blockages, depositing position error, and the like, of the nozzles, on the basis of the image of ejected droplets read in by the image sensor. A test pattern or the target image printed by the print heads 112K, 112C, 112M, and 112Y of the respective colors is read in by the print determination unit 124, and the ejection performed by each head is determined. The ejection determination includes the presence of the ejection, measurement of the dot size, and measurement of the dot depositing position.

The printed matter on which an image has been recorded by the print unit 112 is output from the paper output unit 126. The target print (i.e., the result of printing the target image) and the test print are preferably outputted separately. In the inkjet recording apparatus 110, a sorting device (not shown) is provided for switching the outputting pathways in order to sort the printed matter with the target print and the printed matter with the test print, and to send them to paper output units 126A and 126B, respectively. When the target print and the test print are simultaneously formed in parallel on the same large sheet of paper, the test print portion is cut and separated by a cutter (second cutter) 148. Although not shown in FIG. 12, the paper output unit 126A for the target prints is provided with a sorter for collecting prints according to print orders.

Structure of Head

Next, the structure of the head is described. The heads 112K, 112C, 112M and 112Y of the respective ink colors have the same structure, and a reference numeral 150 is hereinafter designated to any of the heads.

Figure 14A:
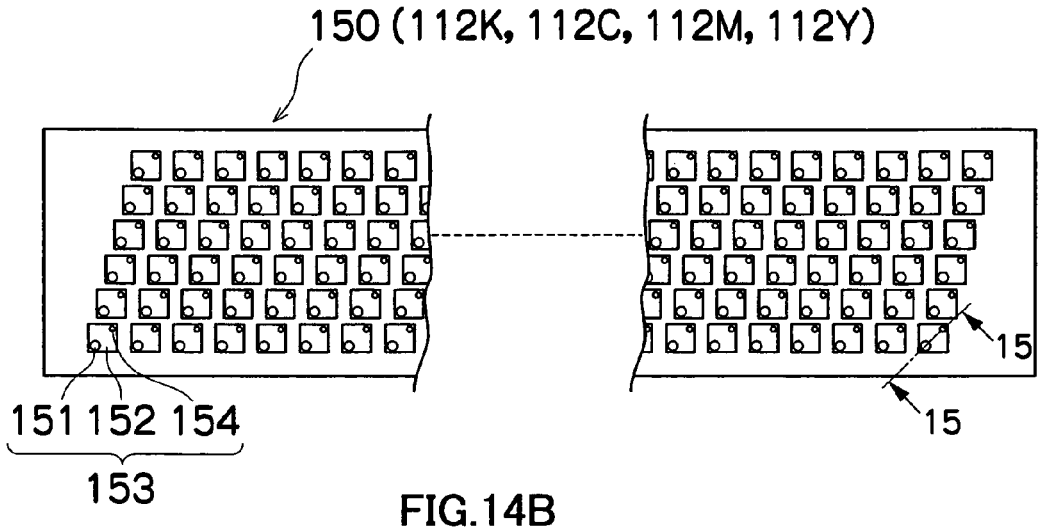
FIG. 14A is a plan view perspective diagram showing an example of the composition of a print head.
Figure 14B:
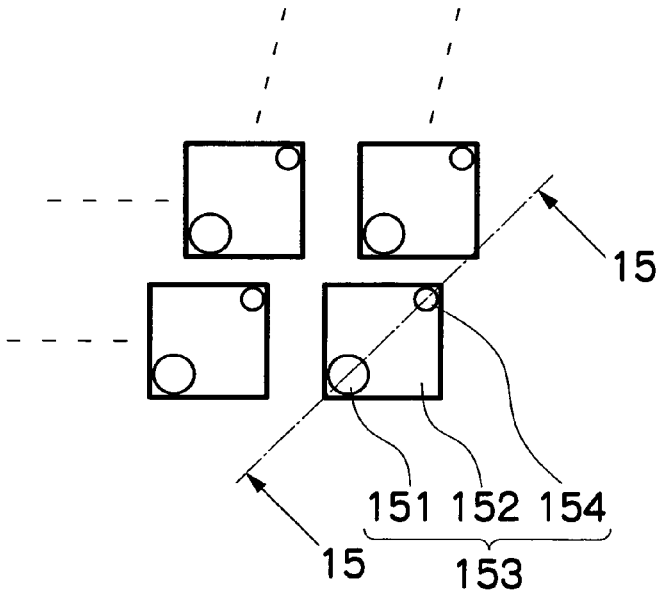
FIG. 14B is a principal enlarged view of FIG. 14A.
Figure 14C:
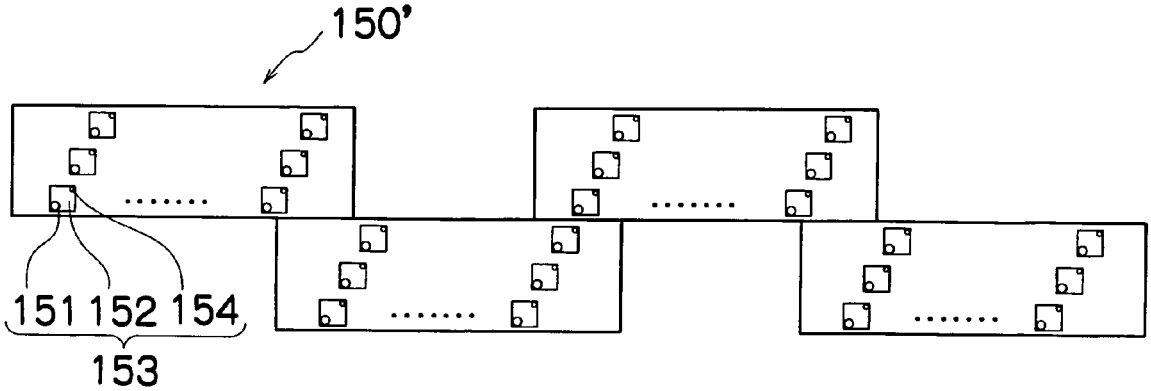
FIG. 14C is a plan view perspective diagram showing another example of the structure of a full line head.
Figure 15:
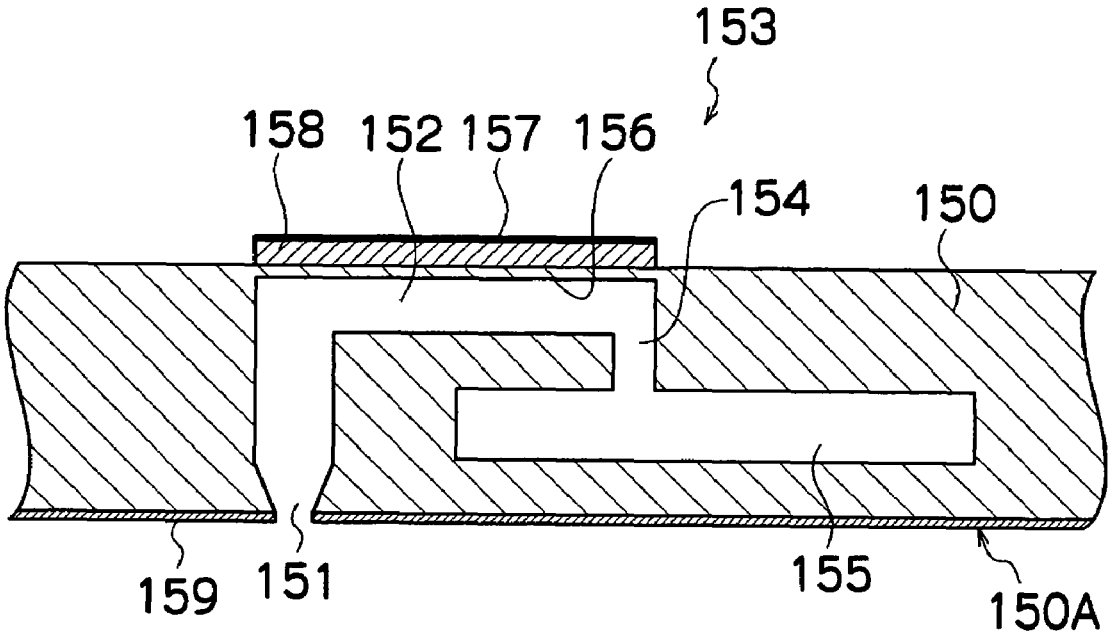
FIG. 15 is a cross-sectional view along line 15-15 in FIG. 14A.

FIG. 14A is a perspective plan view showing an embodiment of the configuration of the head 150, FIG. 14B is an enlarged view of a portion thereof, FIG. 14C is a perspective plan view showing another embodiment of the configuration of the head 150, and FIG. 15 is a cross-sectional view taken along the line 15-15 in FIGS. 14A and 14B, showing the inner structure of a droplet ejection element (an ink chamber unit for one nozzle 151).

The nozzle pitch in the head 150 should be minimized in order to maximize the resolution of the dots printed on the surface of the recording paper 116. As shown in FIGS. 14A and 14B, the head 150 according to the present embodiment has a structure in which a plurality of ink chamber units (droplet ejection elements) 153, each comprising a nozzle 151 forming an ink ejection port, a pressure chamber 152 corresponding to the nozzle 151, and the like, are disposed two-dimensionally in the form of a staggered matrix, and hence the effective nozzle interval (the projected nozzle pitch) as projected in the lengthwise direction of the head (the direction perpendicular to the paper conveyance direction) is reduced and high nozzle density is achieved.

The mode of forming one or more nozzle rows through a length corresponding to the entire width of the recording paper 116 in a direction substantially perpendicular to the conveyance direction of the recording paper 116 is not limited to the embodiment described above. For example, instead of the configuration in FIG. 14A, as shown in FIG. 14C, a line head having nozzle rows of a length corresponding to the entire width of the recording paper 116 can be formed by arranging and combining, in a staggered matrix, short head modules 150' each having a plurality of nozzles 151 arrayed in a two-dimensional fashion.

As shown in FIGS. 14A and 14B, the planar shape of the pressure chamber 152 provided corresponding to each nozzle 151 is substantially a square shape, and an outlet port to the nozzle 151 is provided at one of the ends of the diagonal line of the planar shape, while an inlet port (supply port) 154 for supplying ink is provided at the other end thereof. The shape of the pressure chamber 152 is not limited to that of the present embodiment and various modes are possible in which the planar shape is a quadrilateral shape (rhombic shape, rectangular shape, or the like), a pentagonal shape, a hexagonal shape, or other polygonal shape, or a circular shape, elliptical shape, or the like.

As shown in FIG. 15, each pressure chamber 152 is connected to a common channel 155 through the supply port 154. The common channel 155 is connected to an ink tank (not shown), which is a base tank that supplies ink, and the ink supplied from the ink tank is delivered through the common flow channel 155 to the pressure chambers 152.

An actuator 158 provided with an individual electrode 157 is bonded to a pressure plate (a diaphragm that also serves as a common electrode) 156 which forms the surface of one portion (the ceiling in FIG. 15) of the pressure chambers 152. When a drive voltage is applied to the individual electrode 157 and the common electrode, the actuator 158 deforms, thereby changing the volume of the pressure chamber 152. This causes a pressure change which results in ink being ejected from the nozzle 151. For the actuator 158, it is possible to adopt a piezoelectric element using a piezoelectric body, such as lead zirconate titanate, barium titanate, or the like. When the actuator 158 returns to its original position after ejecting ink by the displacement, the pressure chamber 152 is replenished with new ink from the common flow channel 155, through the supply port 154.

Furthermore, a lyophobic layer 159 is provided on the nozzle surface 150A of the head 150, from the viewpoint of improving ejection stability and the cleaning properties of the ejection surface (nozzle surface 150A). There are no particular restrictions on the method for imparting liquid repelling properties to the nozzle surface 150A (the liquid repelling process method), and possible methods include, for example, a method involving coating of a fluorine-based liquid repelling material, or a method involving the formation of a thin layer on the nozzle surface by vapor deposition of a liquid repelling material, such as particles of a fluorine-based high polymer (PTFE), in a vacuum.

By controlling the driving of the actuators 158 corresponding to the nozzles 151 in accordance with the droplet ejection arrangement data generated from the input image, it is possible to eject ink droplets from the nozzles 151. As shown in FIG. 12, by controlling the ink ejection timing of the nozzles 151 in accordance with the speed of conveyance of the print medium 116 while the recording paper 116 forming the recording medium is conveyed in the sub-scanning direction at a uniform speed, it is possible to record a desired image on the print medium 116.

Figure 16:
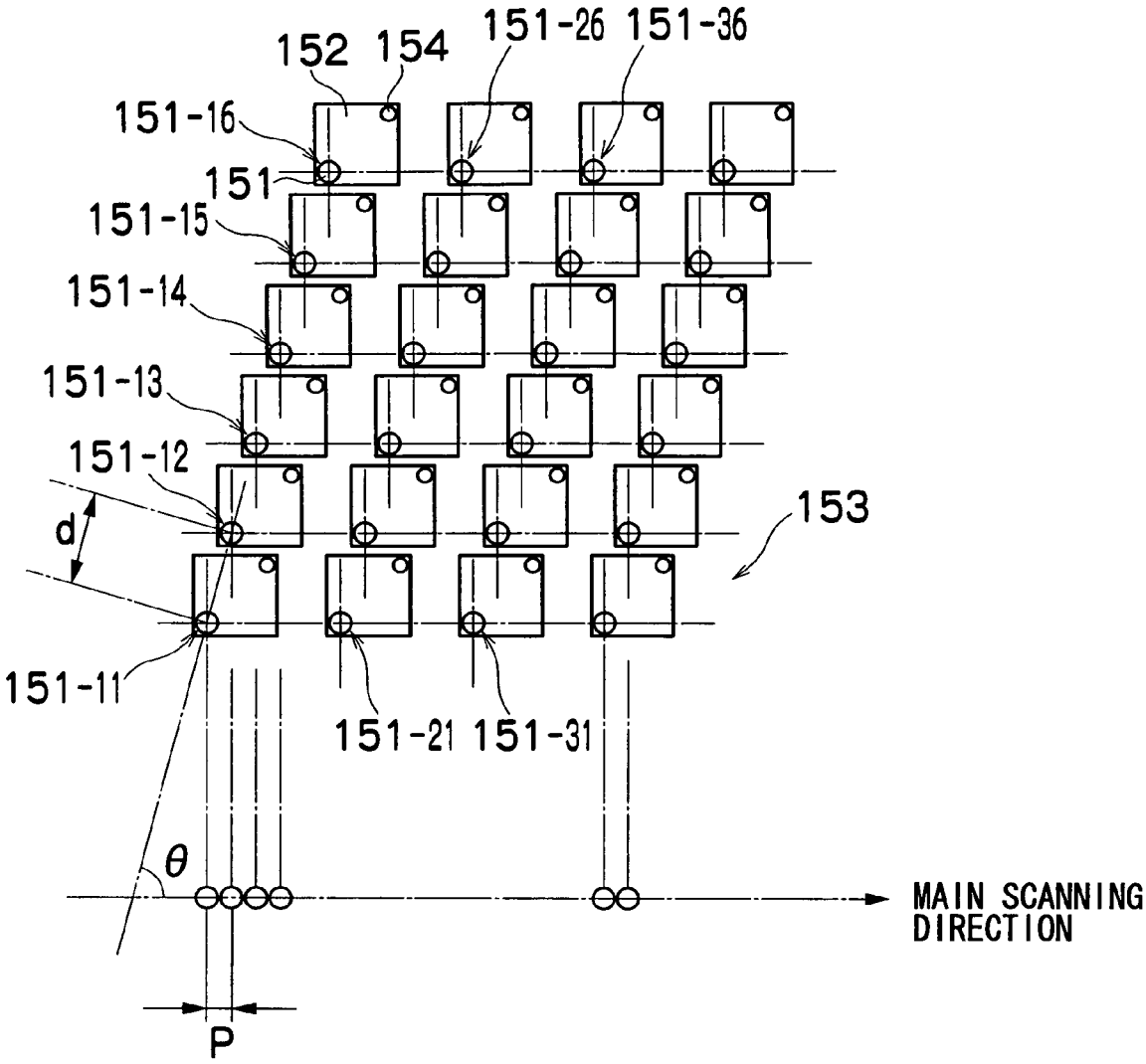
FIG. 16 is an enlarged view showing a nozzle arrangement in the print head illustrated in FIG. 14A.

As shown in FIG. 16, the high-density nozzle head according to the present embodiment is achieved by arranging the plurality of ink chamber units 153 having the above-described structure in a lattice fashion based on a fixed arrangement pattern, in a row direction which coincides with the main scanning direction, and a column direction which is inclined at a fixed angle of $\theta$ with respect to the main scanning direction, rather than being perpendicular to the main scanning direction.

More specifically, by adopting the structure in which the plurality of ink chamber units 153 are arranged at a uniform pitch d in line with a direction forming the angle of $\theta$ with respect to the main scanning direction, the pitch P of the nozzles projected so as to align in the main scanning direction is $d \times \cos\theta$, and hence the nozzles 151 can be regarded to be equivalent to those arranged linearly at the fixed pitch P along the main scanning direction. Such configuration results in a nozzle structure in which the nozzle row projected in the main scanning direction has a high nozzle density of up to 2,400 nozzles per inch.

In a full-line head comprising rows of nozzles that have a length corresponding to the entire width of the image recordable width, the "main scanning" is defined as printing one line (a line formed of a row of dots, or a line formed of a plurality of rows of dots) in the width direction of the recording paper (the direction perpendicular to the conveyance direction of the recording paper) by driving the nozzles in one of the following ways: (1) simultaneously driving all the nozzles; (2) sequentially driving the nozzles from one side toward the other; and (3) dividing the nozzles into blocks and sequentially driving the nozzles from one side toward the other in each of the blocks.

In particular, when the nozzles 151 arranged in a matrix such as that shown in FIG. 16 are driven, the main scanning according to the above-described (3) is preferred. More specifically, the nozzles 151-11, 151-12, 151-13, 151-14, 151-15 and 151-16 are treated as a block (additionally; the nozzles 151-21, 151-22, . . . , 151-26 are treated as another block; the nozzles 151-31, 151-32, . . . , 151-36 are treated as another block; . . . ); and one line is printed in the width direction of the recording paper 116 by sequentially driving the nozzles 151-11, 151-12, . . . , 151-16 in accordance with the conveyance velocity of the recording paper 116.

On the other hand, "sub-scanning" is defined as to repeatedly perform printing of one line (a line formed of a row of dots, or a line formed of a plurality of rows of dots) formed by the main scanning, while moving the full-line head and the recording paper relatively to each other.

The direction indicated by one line (or the lengthwise direction of a band-shaped region) recorded by main scanning as described above is referred to as the "main scanning direction", and the direction in which sub-scanning is performed, is referred to as the "sub-scanning direction". In other words, in the present embodiment, the conveyance direction of the recording paper 116 is referred to as the sub-scanning direction and the direction perpendicular to same is referred to as the main scanning direction.

In implementing the present invention, the arrangement of the nozzles is not limited to that of the embodiment shown. Moreover, a method is employed in the present embodiment where an ink droplet is ejected by means of the deformation of the actuator 158, which is typically a piezoelectric element; however, in implementing the present invention, the method used for discharging ink is not limited in particular, and instead of the piezo jet method, it is also possible to apply various types of methods, such as a thermal jet method where the ink is heated and bubbles are caused to form therein by means of a heat generating body such as a heater, ink droplets being ejected by means of the pressure applied by these bubbles.

Description of Control System

Figure 17:
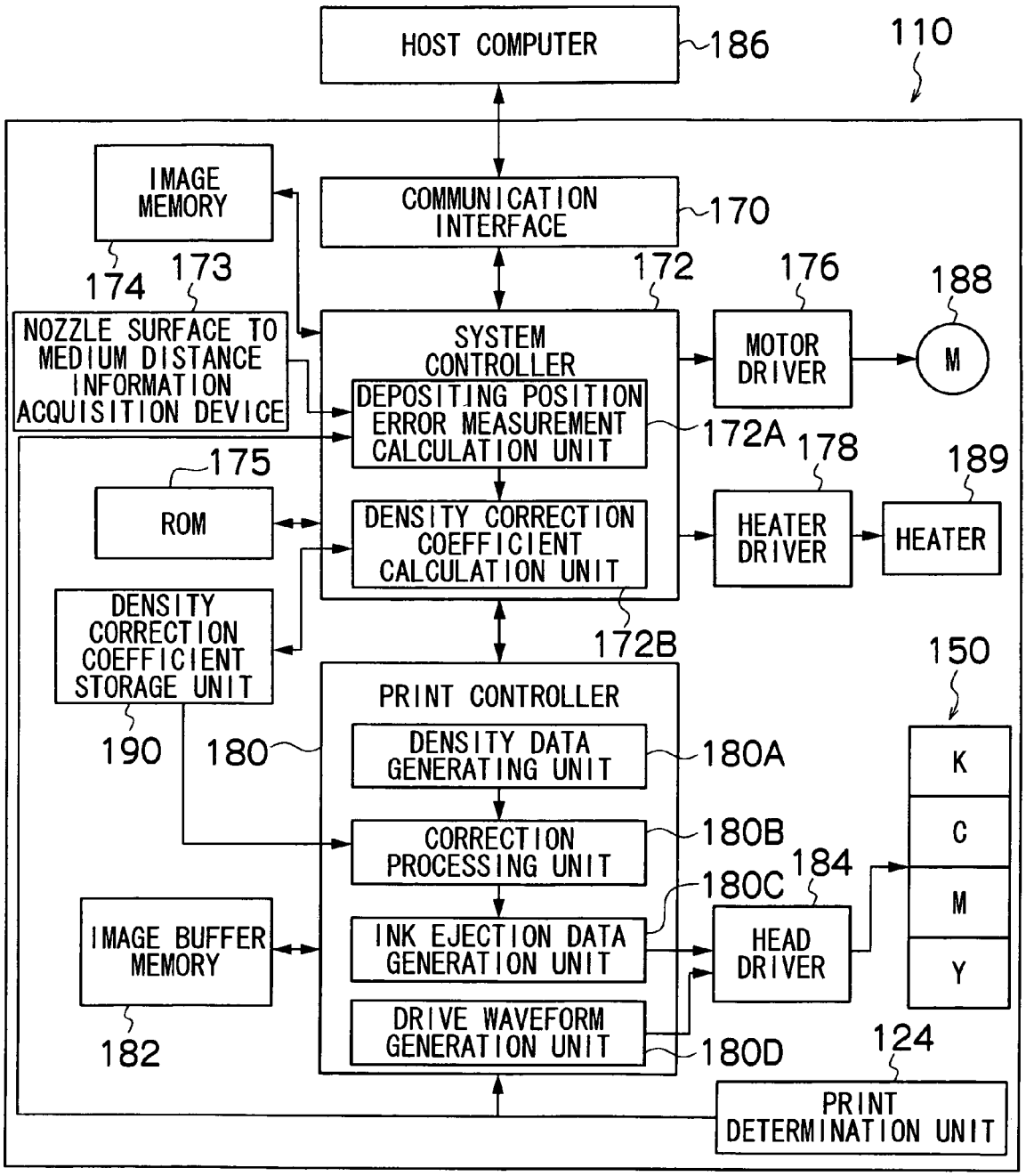
FIG. 17 is a principal block diagram showing the system configuration of the inkjet recording apparatus according to an embodiment of the present invention.

FIG. 17 is a block diagram showing the system configuration of the inkjet recording apparatus 110. The inkjet recording apparatus 110 comprises a communication interface 170, a system controller 172, a nozzle surface to medium distance information acquisition unit 173, an image memory 174, a ROM 175, a motor driver 176, a heater driver 178, a print controller 180, an image buffer memory 182, a head driver 184, and the like.

The communication interface 170 is an interface unit (image input device) for receiving image data sent from a host computer 186. A serial interface such as USB (Universal Serial Bus), IEEE 1394, Ethernet, and wireless network, or a parallel interface such as a Centronics interface may be used as the communication interface 170. A buffer memory (not shown) may be mounted in this portion in order to increase the communication speed.

The image data sent from the host computer 186 is received by the inkjet recording apparatus 110 through the communication interface 170, and is temporarily stored in the image memory 174. The image memory 174 is a storage device for storing images inputted through the communication interface 170, and data is written and read to and from the image memory 174 through the system controller 172. The image memory 174 is not limited to a memory composed of semiconductor elements, and a hard disk drive or another magnetic medium may be used.

The system controller 172 is constituted by a central processing unit (CPU) and peripheral circuits thereof, and the like, and it functions as a control device for controlling the whole of the inkjet recording apparatus 110 in accordance with a prescribed program, as well as a calculation device for performing various calculations. More specifically, the system controller 172 controls the various sections, such as the communication interface 170, image memory 174, motor driver 176, heater driver 178, and the like, as well as controlling communications with the host computer 186 and writing and reading to and from the image memory 174 and the ROM 175, and it also generates control signals for controlling the motor 188 and heater 189 of the conveyance system.

Furthermore, the system controller 172 comprises a depositing error measurement and calculation unit 172A, which performs calculation processing for generating depositing position error data from the distance information obtained from the nozzle surface to medium distance information acquisition unit 173 and the data read in from the test pattern by the print determination unit 124, and a density correction coefficient calculation unit 172B, which calculates density correction coefficients from the information relating to the depositing position error thus obtained. The processing functions of the depositing error measurement and calculation unit 172A and the density correction coefficient calculation unit 172B can be achieved by means of an ASIC (application specific integrated circuit), software, or a suitable combination of same.

The density correction coefficient data obtained by the density correction coefficient calculation unit 172B is stored in a density correction coefficient storage unit 190.

Embodiments of the nozzle surface to medium distance information acquisition unit 173 include various modes, such as a distance measurement unit 123 described in FIG. 12, and a user interface whereby a user could input the thickness information relating to the recording medium (recording paper 116).

The program executed by the CPU of the system controller 172 and the various types of data (including, for example, data of the test pattern for obtaining depositing position error, formulas for calculating the amount of depositing position displacement, look-up tables, and the values of Ya and Xai) which are required for control procedures are stored in the ROM 175. The ROM 175 may be a non-rewriteable storage device, but when the information on Xai is updated, desirably, a rewriteable storage device such as an EEPROM is used. By utilizing the storage region of this ROM 175, the ROM 175 can be configured to be able to serve also as the density correction coefficient storage unit 190.

The image memory 174 is used as a temporary storage region for the image data, and it is also used as a program development region and a calculation work region for the CPU.

The motor driver (drive circuit) 176 drives the motor 188 of the conveyance system in accordance with commands from the system controller 172. The heater driver (drive circuit) 178 drives the heater 189 of the post-drying unit 142 or the like in accordance with commands from the system controller 172.

The print controller 180 is a control unit which functions as a signal processing device for performing various treatment processes, corrections, and the like, in accordance with the control implemented by the system controller 172, in order to generate a signal for controlling droplet ejection from the image data (multiple-value input image data) in the image memory 174, as well as functioning as an ejection control device which controls the ejection driving of the head 150 by supplying the ink ejection data thus generated to the head driver 184.

In other words, the print controller 180 includes a density data generation unit 180A, a correction processing unit 180B, an ink ejection data generation unit 180C and a drive waveform generation unit 180D. These functional units (180A to 180D) can be realized by means of an ASIC, software or a suitable combination of same.

The density data generation unit 180A is a signal processing device which generates initial density data for the respective ink colors, from the input image data, and it carries out density conversion processing (including UCR processing and color conversion) described in step S22 in FIG. 9, and, where necessary, it also performs pixel number conversion processing.

The correction processing unit 180B in FIG. 17 is a processing device which performs density correction calculations using the density correction coefficients stored in the density correction coefficient storage unit 190, and it carries out the non-uniformity correction processing described in step S32 in FIG. 9.

The ink ejection data generation unit 180C in FIG. 17 is a signal processing device which includes a half-toning processing device for converting the corrected density data generated by the correction processing unit 180B into binary (or multiple-value) droplet ejection arrangement data (dot data), and it performs the binary (or multiple-value) conversion processing described in step S42 in FIG. 9. The ink ejection data generated by the ink ejection data generation unit 180C is supplied to the head driver 184, which controls the ink ejection operation of the head 150 accordingly.

The drive waveform generation unit 180D is a device for generating drive signal waveforms in order to drive the actuators 158 (see FIG. 12) corresponding to the respective nozzles 151 of the head 150. The signal (drive waveform) generated by the drive waveform generation unit 180D is supplied to the head driver 184. The signal outputted from the drive signal generation unit 180D may be digital waveform data, or it may be an analog voltage signal.

The image buffer memory 182 is provided in the print controller 180, and image data, parameters, and other data are temporarily stored in the image buffer memory 182 when image data is processed in the print controller 180. FIG. 17 shows a mode in which the image buffer memory 182 is attached to the print controller 180; however, the image memory 174 may also serve as the image buffer memory 182. Also possible is a mode in which the print controller 180 and the system controller 172 are integrated to form a single processor.

To give a general description of the sequence of processing from image input to print output, image data to be printed (original image data) is inputted from an external source through the communication interface 170, and is accumulated in the image memory 174. At this stage, multiple-value RGB image data is stored in the image memory 174, for example.

In this inkjet recording apparatus 110, an image which appears to have a continuous tonal graduation to the human eye is formed by changing the deposition density and the dot size of fine dots created by ink (coloring material), and therefore, it is necessary to convert the input digital image into a dot pattern which reproduces the tonal graduations of the image (namely, the light and shade toning of the image) as faithfully as possible. Therefore, original image data (RGB data) stored in the image memory 174 is sent to the print controller 180, through the system controller 172, and is converted to the dot data for each ink color by a half-toning technique, using dithering, error diffusion, or the like, by passing through the density data generation unit 180A, the correction processing unit 180B, and the ink ejection data generation unit 180C of the print controller 180.

In other words, the print controller 180 performs processing for converting the input RGB image data into dot data for the four colors of K, C, M and Y. The dot data thus generated by the print controller 180 is stored in the image buffer memory 182. This dot data of the respective colors is converted into CMYK droplet ejection data for ejecting ink from the nozzles of the head 150, thereby establishing the ink ejection data to be printed.

The head driver 184 outputs drive signals for driving the actuators 158 corresponding to the nozzles 151 of the head 150 in accordance with the print contents, on the basis of the ink ejection data and the drive waveform signals supplied by the print controller 180. A feedback control system for maintaining constant drive conditions in the head may be included in the head driver 184.

By supplying the drive signals outputted by the head driver 184 to the head 150 in this way, ink is ejected from the corresponding nozzles 151. By controlling ink ejection from the print head 150 in synchronization with the conveyance speed of the recording paper 116, an image is formed on the recording paper 116.

As described above, the ejection volume and the ejection timing of the ink droplets from the respective nozzles are controlled through the head driver 184, on the basis of the ink ejection data generated by implementing prescribed signal processing in the print controller 180, and the drive signal waveform. By this means, prescribed dot size and dot positions can be achieved.

As described with reference to FIG. 12, the print determination unit 124 is a block including an image sensor, which reads in the image printed on the recording medium 116, performs various signal processing operations, and the like, and determines the print situation (presence/absence of ejection, variation in depositing positions of droplet ejection, optical density, and the like), these determination results being supplied to the print controller 180 and the system controller 172.

The print controller 180 implements various corrections with respect to the head 150, on the basis of the information obtained from the print determination unit 124, according to requirements, and it implements control for carrying out cleaning operations (nozzle restoring operations), such as preliminary ejection, suctioning, or wiping, as and when necessary.

In the case of the present embodiment, the nozzle surface to medium distance information acquisition unit 173 corresponds to a "distance identification device", a "second distance information acquisition device" and a "measurement device". The depositing position error measurement and calculation device 172A corresponds to a "depositing position error calculation device" and a "second depositing position error calculation device". Furthermore, the ROM 175 corresponds to a "storage device", and the composition where the information on Ya and Xai stored in the ROM 175 is used corresponds to a "first depositing position error information acquisition device". Moreover, the composition of the print controller 180 comprising the density data generation unit 180A, the correction processing unit 180B, and the ink ejection data generation unit 180C, corresponds to a "droplet ejection arrangement determination device" and an "ejection control device". The combination of the system controller 172 and the print controller 180 which execute the printing of a test pattern on the basis of the test pattern data in the ROM 175 corresponds to a "test pattern recording control device".

Furthermore, the density correction coefficient calculation unit 172B corresponds to a "correction range setting device" and a "correction coefficient determination device", and the correction processing unit 180B corresponds to a "correction processing device".

According to the inkjet recording apparatus 110 having the composition described above, correction of the image data is carried out with reference to the depositing position error corresponding to the distance between the nozzle surface and the medium surface, at a stage prior to the halftoning process, and therefore, banding (non-uniformity) caused by depositing position errors can be corrected with good accuracy. Furthermore, the corrective functions of the present embodiment can be achieved at low cost, since they do not require the addition of a mechanical distance control mechanism or of drive elements for deflecting the flight of the droplets.

MODIFICATION EXAMPLE

It is also possible to adopt a mode in which all or a portion of the functions carried out by the depositing error measurement calculation unit 172A, the density correction coefficient calculation unit 172B, the density data generation unit 180A, and the correction processing unit 180B, which are described in FIG. 17, are installed in the host computer 186.

Moreover, the application of the present invention is not limited to a line head type of printer, and beneficial correction effects with respect to streaks can also be obtained in a shuttle scanning type of printer.

Furthermore, in implementing embodiments of the present invention, the method of correction processing based on the information on the amount Xbi of depositing position displacement is not limited to the example described in detail in FIGS. 3 to 11, and it is also possible to adopt another correction method.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An image processing method comprising the steps of:

obtaining a distance between an ejection surface of a liquid ejection head in which a plurality of liquid droplet ejection ports are formed, and a recording surface onto which liquid droplets ejected from the liquid droplet ejection ports are deposited;

identifying an amount of depositing position displacement of the liquid droplet ejected from each of the liquid droplet ejection ports on the recording surface, according to the distance; and generating droplet ejection arrangement data by correcting image data according to the identified amount of depositing position displacement and performing a halftoning process of the corrected image data.

2. An image processing method comprising the steps of:

acquiring information on an amount of depositing position displacement of a liquid droplet ejected from each of liquid droplet ejection ports, the amount of depositing position displacement being measured on a first recording surface situated at a first distance from an ejection surface of a liquid ejection head in which the liquid droplet ejection ports are formed;

acquiring information on a second distance with respect to a second recording surface situated at the second distance from the ejection surface, the second distance being different from the first distance;

determining an amount of depositing position displacement on the second recording surface according to the first distance, the second distance, and the amount of depositing position displacement measured on the first recording surface; and generating droplet ejection arrangement data by correcting image data according to the amount of depositing position displacement measured on the second recording surface and performing a halftoning process of the corrected image data.

3. The image processing method as defined in claim 2, wherein the first distance is longer than the second distance.

4. An image processing apparatus comprising:

a distance identification device which identifies a distance between an ejection surface of a liquid ejection head in which a plurality of liquid droplet ejection ports are formed, and a recording surface onto which liquid droplets ejected from the liquid droplet ejection ports are deposited;

a depositing position error calculation device which determines an amount of depositing position displacement of the liquid droplet ejected from each of the liquid droplet ejection ports on the recording surface, according to the distance; and a droplet ejection arrangement determination device which generates droplet ejection arrangement data by correcting image data according to the amount of depositing position displacement determined by the depositing position error calculation device and performing a halftoning process of the corrected image data.

5. The image processing apparatus as defined in claim 4, wherein the droplet ejection arrangement determination device comprises:

a correction range setting device which sets N liquid droplet ejection ports used for correcting output density (where N is an integer not less than 2), of the liquid droplet ejection ports;

a correction coefficient determination device which determines density correction coefficients for liquid droplets ejected from the N liquid droplet ejection ports, according to a correction condition including a condition whereby a differential coefficient at a frequency origin (f=0) of a power spectrum representing spatial frequency characteristics of density non-uniformities occurring due to a depositing position error of each of the liquid droplets ejected from the liquid droplet ejection ports, becomes substantially zero; and a correction processing device which performs calculation for correcting the output density by using the density correction coefficients determined by the correction coefficient determination device.

6. An image processing apparatus comprising:

a first depositing position error information acquisition device which acquires information on an amount of depositing position displacement of a liquid droplet ejected from each of liquid droplet ejection ports, the amount of depositing position displacement being measured on a first recording surface situated at a first distance from an ejection surface of a liquid ejection head in which the liquid droplet ejection ports are formed;

a second distance information acquisition device which acquires information on a second distance with respect to a second recording surface situated at the second distance from the ejection surface, the second distance being different from the first distance;

a second depositing position error calculation device which determines an amount of depositing position displacement on the second recording surface according to the first distance, the second distance, and the amount of depositing position displacement measured on the first recording surface; and a droplet ejection arrangement determination device which generates droplet ejection arrangement data by correcting image data according to the amount of depositing position displacement on the second recording surface determined by means of the second depositing position error calculation device and performing a halftoning process of the corrected image data.

7. The image processing apparatus as defined in claim 6, wherein the droplet ejection arrangement determination device comprises:

a correction range setting device which sets N liquid droplet ejection ports used for correcting output density (where N is an integer not less than 2), of the liquid droplet ejection ports;

a correction coefficient determination device which determines density correction coefficients for liquid droplets ejected from the N liquid droplet ejection ports, according to a correction condition including a condition whereby a differential coefficient at a frequency origin (f=0) of a power spectrum representing spatial frequency characteristics of density non-uniformities occurring due to a depositing position error of each of the liquid droplets ejected from the liquid droplet ejection ports, becomes substantially zero; and a correction processing device which performs calculation for correcting the output density by using the density correction coefficients determined by the correction coefficient determination device.

8. An image recording apparatus comprising:

a liquid ejection head in which a plurality of liquid droplet ejection ports are formed;

a conveyance device which causes the liquid ejection head and a recording medium to move relatively to each other by conveying at least one of the liquid ejection head and the recording medium;

a storage device which stores information on a first distance and information on an amount of depositing position displacement of a liquid droplet ejected from each of the liquid droplet ejection ports, the amount of depositing position displacement being measured on a first recording surface situated at the first distance from an ejection surface of the liquid ejection head;

a second distance information acquisition device which acquires information on a second distance with respect to a second recording surface situated at the second distance from the ejection surface, the second distance being different from the first distance;

a second depositing position error calculation device which determines an amount of depositing position displacement on the second recording surface according to the first distance stored in the storage device, the amount of depositing position displacement on the first recording surface stored in the storage device, and the second distance acquired by the second distance information acquisition device;

a droplet ejection arrangement determination device which generates droplet ejection arrangement data by correcting image data according to the amount of depositing position displacement on the second recording surface determined by means of the second depositing position error calculation device and performing a halftoning process of the corrected image data; and an ejection control device which controls an ejection operation of the liquid droplet ejection ports according to the droplet ejection arrangement data generated by the droplet ejection arrangement determination device.

9. The image recording apparatus as defined in claim 8, further comprising:

a test pattern recording control device which controls ejection driving of the liquid ejection head in such a manner that a prescribed test pattern is recorded on the first recording surface; and a measurement device which measures the amount of depositing position displacement according to the test pattern recorded onto the first recording surface, wherein the information on the amount of depositing position displacement measured by the measurement device is stored in the storage device.

10. The image recording apparatus as defined in claim 8, wherein the first recording surface is a surface of a conveyance belt which serves to convey the recording medium.

* * * * *